US011898763B2

(12) United States Patent
Yamada

(10) Patent No.: US 11,898,763 B2
(45) Date of Patent: Feb. 13, 2024

(54) AIR CONDITIONING SYSTEM WITH REFRIGERANT LEAK MANAGEMENT

(71) Applicant: DAIKIN INDUSTRIES, LTD., Osaka (JP)

(72) Inventor: Miki Yamada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 452 days.

(21) Appl. No.: 17/262,552

(22) PCT Filed: Jul. 25, 2018

(86) PCT No.: PCT/JP2018/027948
§ 371 (c)(1),
(2) Date: Jan. 22, 2021

(87) PCT Pub. No.: WO2020/021661
PCT Pub. Date: Jan. 30, 2020

(65) Prior Publication Data
US 2021/0293430 A1 Sep. 23, 2021

(51) Int. Cl.
*F24F 11/36* (2018.01)
*F24F 11/86* (2018.01)
(Continued)

(52) U.S. Cl.
CPC ..... *F24F 11/36* (2018.01); *F24F 11/86* (2018.01); *F25B 49/02* (2013.01); *F24F 2110/12* (2018.01); *F24F 2140/00* (2018.01); *F24F 2221/54* (2013.01); *F25B 2500/222* (2013.01); *F25B 2700/2106* (2013.01)

(58) Field of Classification Search
CPC .... F25B 49/02; F25B 13/00; F25B 2500/222; F25B 49/005; F25B 2700/2104;
(Continued)

(56) References Cited

U.S. PATENT DOCUMENTS 4,220,010 A * 9/1980 Mueller ..... F25B 49/02 62/126
6,318,150 B1 11/2001 Temple
(Continued)

FOREIGN PATENT DOCUMENTS

JP S55-82265 A 6/1980
JP 2000-200395 A 7/2000
(Continued)

OTHER PUBLICATIONS

English translation of the International Preliminary Report on Patentability issued in corresponding International Patent Application No. PCT/JP2018/027948, dated Feb. 4, 2021 (9 pages).
(Continued)

*Primary Examiner* — Henry T Crenshaw
(74) *Attorney, Agent, or Firm* — Osha Bergman Watanabe & Burton LLP

(57) ABSTRACT

An air conditioning system includes: a controller that controls an air conditioner; a thermostat that measures a temperature of an air conditioning target space, changes a contact point to an ON state or an OFF state in accordance with a measurement result, and manages input of a control signal to the controller to control operation of a component of the air conditioner; a connection line group that electrically connects the thermostat and the controller; a relay that switches, to either a conductive state or a cut-off state, at least one of a first connection line that controls a compressor of the air conditioner or a second connection line that controls an indoor fan of the air conditioner, among the connection line group; and a leakage detection sensor that detects refrigerant leakage from the air conditioner, and outputs a signal that controls the relay.

10 Claims, 11 Drawing Sheets

(51) Int. Cl.

| | |
|---|---|
| ***F25B 49/02*** | (2006.01) |
| ***F24F 140/00*** | (2018.01) |
| ***F24F 110/12*** | (2018.01) |

(58) Field of Classification Search
CPC ..... F25B 2700/2106; F24F 2221/54; F24F 11/36; F24F 2110/12; F24F 2140/00
See application file for complete search history.

(56) References Cited

U.S. PATENT DOCUMENTS

| | | | | |
|---|---|---|---|---|
| 9,168,315 | B1 * | 10/2015 | Scaringe | F24F 11/30 |
| 10,982,862 | B1 * | 4/2021 | Kaiser | F24D 12/02 |
| 2002/0178738 | A1 | 12/2002 | Taira et al. | |
| 2017/0198936 | A1 * | 7/2017 | Yamaguchi | F24F 11/74 |
| 2019/0170604 | A1 * | 6/2019 | Kester | G01M 3/226 |
| 2019/0390876 | A1 * | 12/2019 | Matsuda | F25B 49/02 |

FOREIGN PATENT DOCUMENTS

| | | | |
|---|---|---|---|
| JP | 2002-098393 | A | 4/2002 |
| JP | 2013-122364 | A | 6/2013 |
| WO | 2009/017851 | A1 | 2/2009 |

OTHER PUBLICATIONS

International Search Report issued in International Application No. PCT/JP2018/027948, dated Oct. 16, 2018 (5 pages).
Written Opinion issued in International Application No. PCT/JP2018/027948, dated Oct. 16, 2018 (5 pages).

* cited by examiner

AIR CONDITIONING SYSTEM WITH REFRIGERANT LEAK MANAGEMENT

TECHNICAL FIELD

An air conditioning system that operates an air conditioner with an ON or OFF signal from a thermostat.

BACKGROUND

Conventionally, an air conditioning system that operates an air conditioner with an ON or OFF signal from a thermostat has become widespread. For example, in an air conditioning system disclosed in Patent Document 1 (WO 2009/017851 A), a thermostat communicates with an evaporator unit controller and a condenser unit controller by using relatively low voltage control wiring, but there is no communication between the evaporator unit controller and the condenser unit controller.

CITATION LIST

Patent Literature

Patent Literature 1: WO 2009/017851 A

In the air conditioning system that operates the air conditioner only with an ON or OFF signal from the thermostat as described above, the thermostat cannot be controlled even if the air conditioner shows a sign of refrigerant leakage, and appropriate refrigerant leakage measures cannot be taken. Therefore, the object to be achieved is to enable appropriate refrigerant leakage measures for the air conditioner regardless of a control signal from the thermostat to the air conditioner, when refrigerant leakage from the air conditioner is detected.

SUMMARY

According to one or more embodiments, an air conditioning system includes a controller that controls an air conditioner, a thermostat, a connection line group, a relay, and a leakage detection sensor. The thermostat measures a temperature of an air conditioning target space, changes a contact point to an ON state or an OFF state in accordance with a measurement result, and switches input and non-input of (i.e., manages) a control signal to the controller, to cause operation of components of the air conditioner. The connection line group electrically connects the thermostat and the controller. The relay switches, to either a conductive state or cut-off state, at least one of a first connection line to cause operation of a compressor of the air conditioner or a second connection line to cause operation of an indoor fan of the air conditioner, among the connection line group. The leakage detection sensor detects refrigerant leakage from the air conditioner, and outputs a signal for operating the relay.

In one or more embodiments of this air conditioning system, when refrigerant leakage is detected, at least one of the first connection line to cause operation of the compressor of the air conditioner or the second connection line to cause operation of the indoor fan of the air conditioner can be switched to either the conductive state or the cut-off state, regardless of a control signal of the thermostat.

In one or more embodiments of this air conditioning system, the connection line group further includes a third connection line for operation of a four-way switching valve of the air conditioner. When the leakage detection sensor detects refrigerant leakage from the air conditioner, the relay switches the third connection line to either a conductive state or a cut-off state.

In one or more embodiments, an air conditioning system further includes a heater that is provided separately from the air conditioner, for heating an air conditioning target space. The connection line group further includes a fourth connection line to cause operation of the heater. When the leakage detection sensor detects refrigerant leakage from the air conditioner, the relay switches the fourth connection line to either a conductive state or a cut-off state.

In one or more embodiments of this air conditioning system, the connection line group further includes a fifth connection line for transmission of a signal from the controller to the thermostat to notify that an abnormality has occurred. When the leakage detection sensor detects refrigerant leakage from the air conditioner, the relay switches the fifth connection line to either a conductive state or a cut-off state.

In one or more embodiments of this air conditioning system, each connection line in the connection line group includes at least one of a communication line and a terminal.

In one or more embodiments, an air conditioning system further includes a utilization unit and a heat source unit.

DETAILED DESCRIPTION

(1) Configuration of Air Conditioning System 1

Figure 1:
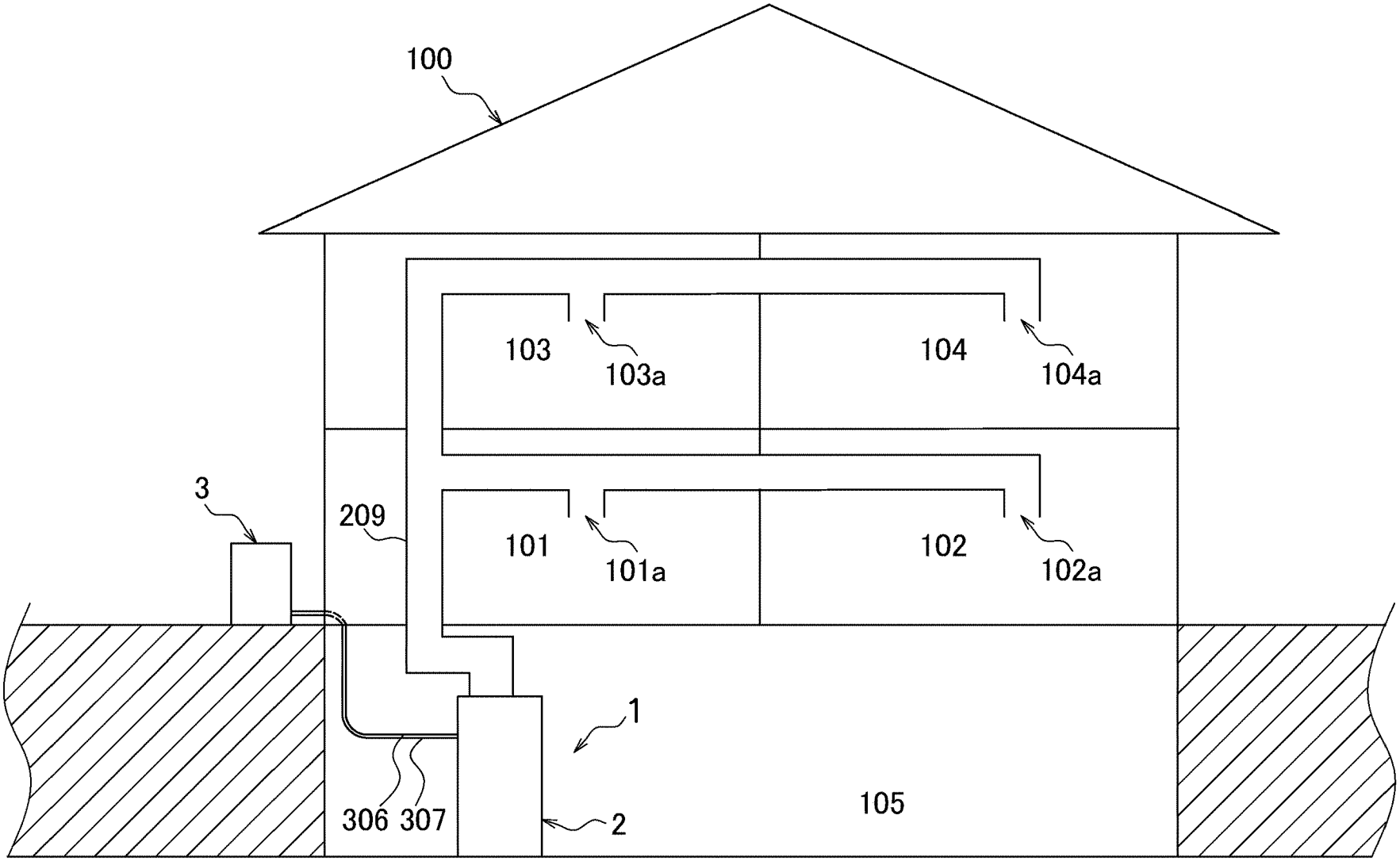
FIG. 1 is an exemplary view showing an arrangement of an air conditioning system according to one or more embodiments of the present invention.
Figure 2:
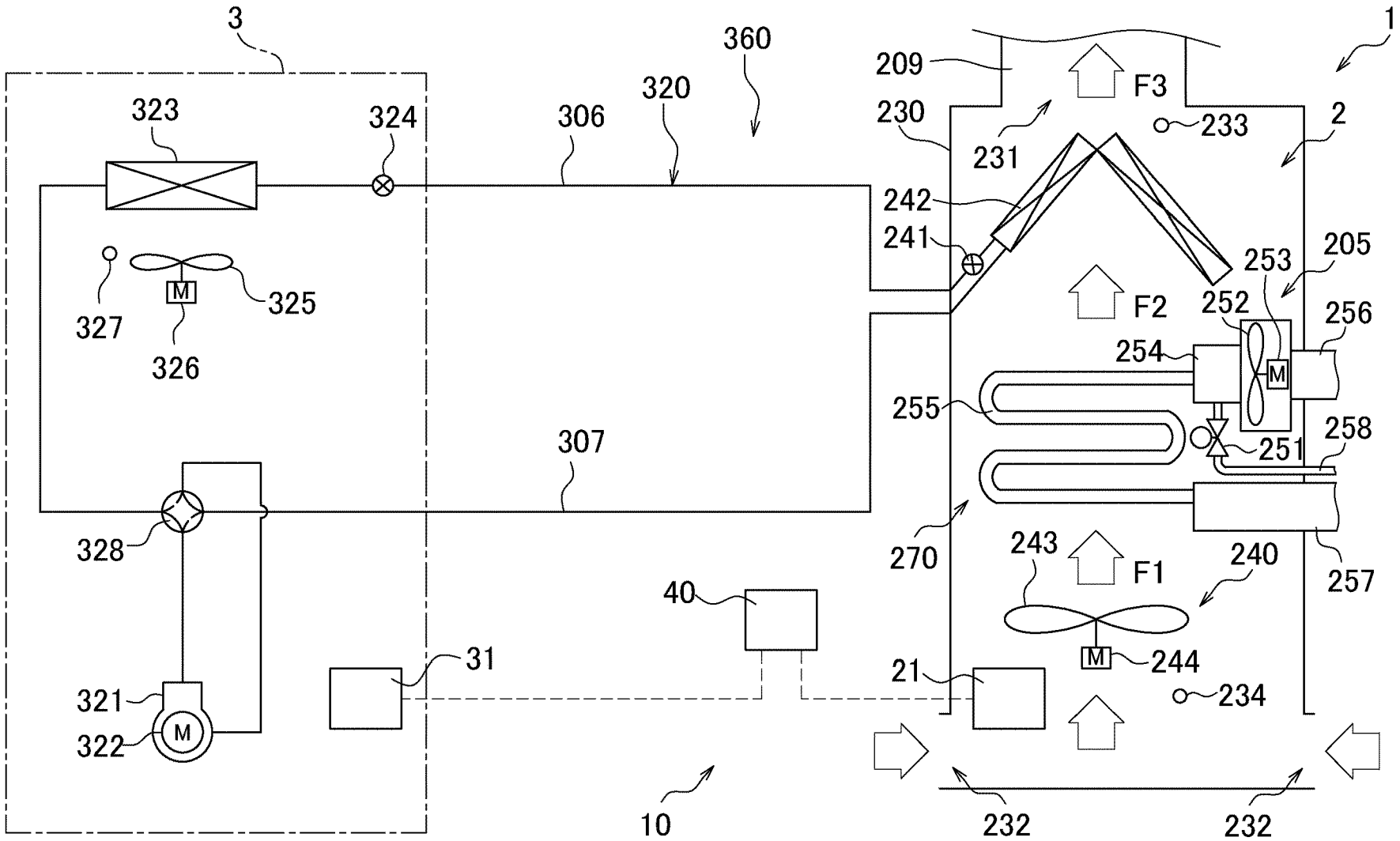
FIG. 2 is a schematic configuration diagram of the air conditioning system according to one or more embodiments of the present invention.

FIG. 1 is an exemplary view showing an arrangement of an air conditioning system 1 according to one or more embodiments of the present invention. FIG. 2 is a schematic configuration diagram of the air conditioning system 1. In FIGS. 1 and 2, the air conditioning system 1 is a device used for air conditioning of a house or a building.

Here, the air conditioning system 1 is installed in a two-story house 100. In the house 100, rooms 101 and 102 are provided on the first floor, and rooms 103 and 104 are provided on the second floor. In addition, the house 100 is provided with a basement 105.

The air conditioning system 1 is a so-called duct air conditioning system. The air conditioning system 1 has an indoor unit 2, an outdoor unit 3, refrigerant connection pipes 306 and 307, and a duct 209 that sends air that has been air-conditioned by the indoor unit 2 to the rooms 101 to 104. The duct 209 is branched into the rooms 101 to 104, and is connected to ventilation ports 101*a* to 104*a* of the individual rooms 101 to 104. Note that, for convenience of explanation, the indoor unit 2, the outdoor unit 3, and the refrigerant connection pipes 306 and 307 are collectively referred to as an air conditioner 10.

In FIG. 2, the indoor unit 2, the outdoor unit 3, and the refrigerant connection pipes 306 and 307 constitute a heat pump unit 360 that heats a room by a vapor compression refrigeration cycle. Further, a gas furnace unit 205, which is a part of the indoor unit 2, constitutes a separate heat source unit 270 that heats a room by a heat source (here, heat from gas combustion) separate from the heat pump unit 360.

As described above, in addition to a part that constitutes the heat pump unit 360, the indoor unit 2 has the gas furnace unit 205 that constitutes the separate heat source unit 270. In addition, the indoor unit 2 also has an indoor fan 240 that takes in air in the rooms 101 to 104 into a housing 230 and supplies the air that has been air-conditioned by the heat pump unit 360 and the separate heat source unit 270 (the gas furnace unit 205) into the rooms 101 to 104. In addition, the indoor unit 2 is provided with a blow-out air temperature sensor 233 that detects a blow-out air temperature Trd, which is a temperature of air at an air outflow port 231 of the housing 230, and an indoor temperature sensor 234 that detects an indoor temperature Tr, which is a temperature of air at an air inflow port 232 of the housing 230. Note that the indoor temperature sensor 234 may be provided in the rooms 101 to 104 instead of the indoor unit 2.

(1-1) Heat Pump Unit 360

In the heat pump unit 360 of the air conditioner 10, a refrigerant circuit 320 is configured by connecting the indoor unit 2 and the outdoor unit 3 via the refrigerant connection pipes 306 and 307. The refrigerant connection pipes 306 and 307 are refrigerant pipes constructed on-site when the air conditioner 10 is installed.

The indoor unit 2 is installed in the basement 105 of the house 100. Note that an installation location of the indoor unit 2 is not limited to the basement 105, and may be installed at another indoor place. The indoor unit 2 includes an indoor heat exchanger 242 as a refrigerant radiator that heats air through heat radiation from a refrigerant in the refrigeration cycle, and an indoor expansion valve 241.

During a cooling operation, the indoor expansion valve 241 decompresses the refrigerant circulating in the refrigerant circuit 320, and causes the refrigerant to flow through the indoor heat exchanger 242. Here, the indoor expansion valve 241 is an electric expansion valve connected to a liquid side of the indoor heat exchanger 242.

The indoor heat exchanger 242 is arranged on a most leeward side of a ventilation path from the air inflow port 232 to the air outflow port 231 formed in the housing 230.

The outdoor unit 3 is installed outside of the house 100. The outdoor unit 3 has a compressor 321, an outdoor heat exchanger 323, an outdoor expansion valve 324, and a four-way switching valve 328. The compressor 321 is a hermetic compressor that houses, in a casing, a compression element (not illustrated) and a compressor motor 322 that drives the compression element.

The compressor motor 322 is supplied with electric power via an inverter device (not illustrated), and allows an operating capacity to be varied by changing a frequency (that is, a number of revolutions) of the inverter device.

The outdoor heat exchanger 323 is a heat exchanger that functions as a refrigerant evaporator that evaporates the refrigerant in the refrigeration cycle by outdoor air. Near the outdoor heat exchanger 323, an outdoor fan 325 that sends outdoor air to the outdoor heat exchanger 323 is provided. The outdoor fan 325 is driven to rotate by an outdoor fan motor 326.

During a heating operation, the outdoor expansion valve 324 decompresses the refrigerant circulating in the refrigerant circuit 320, and causes the refrigerant to flow through the outdoor heat exchanger 323. Here, the outdoor expansion valve 324 is an electric expansion valve connected to a liquid side of the outdoor heat exchanger 323. Further, the outdoor unit 3 is provided with an outdoor temperature sensor 327 that detects a temperature of outdoor air outside of the house 100 where the outdoor unit 3 is arranged, that is, an outside air temperature Ta.

The four-way switching valve 328 is a valve to switch a refrigerant flow direction. During a cooling operation, the four-way switching valve 328 connects a discharge side of the compressor 321 and a gas side of the outdoor heat exchanger 323, and also connects a suction side of the compressor 321 and a gas-refrigerant connection pipe 307 (a cooling operation state: see a solid line of the four-way switching valve 328 in FIG. 2). As a result, the outdoor heat exchanger 323 functions as a refrigerant condenser, and the indoor heat exchanger 242 functions as a refrigerant evaporator.

During a heating operation, the four-way switching valve 328 connects a discharge side of the compressor 321 and the gas-refrigerant connection pipe 307, and also connects a suction side of the compressor 321 and a gas side of the outdoor heat exchanger 323 (a heating operation state: see a broken line of the four-way switching valve 328 in FIG. 2). As a result, the indoor heat exchanger 242 functions as a refrigerant condenser, and the outdoor heat exchanger 323 functions as a refrigerant evaporator.

(1-2) Separate Heat Source Unit 270

The separate heat source unit 270 is configured by the gas furnace unit 205 that is a part of the indoor unit 2 of the air conditioner 10.

The gas furnace unit 205 is provided in the housing 230 installed in the basement 105 of the house 100. The gas furnace unit 205 is a gas combustion heating device, and includes a fuel gas valve 251, a furnace fan 252, a combustion unit 254, a furnace heat exchanger 255, an air supply pipe 256, and an exhaust pipe 257.

The fuel gas valve 251 is configured by an electromagnetic valve or the like controlled to open and close, and is provided in a fuel gas supply pipe 258 extending from outside of the housing 230 to the combustion unit 254. As the fuel gas, natural gas, petroleum gas, and the like are used.

The furnace fan 252 is a fan that generates an air flow of taking in air into the combustion unit 254 through the air supply pipe 256, then sending the air to the furnace heat exchanger 255, and discharging from the exhaust pipe 257. The furnace fan 252 is driven to rotate by a furnace fan motor 253.

The combustion unit 254 is a device that obtains high-temperature combustion gas by burning mixed gas of fuel gas and air, with a gas burner or the like (not illustrated).

The furnace heat exchanger 255 is a heat exchanger that heats air by heat radiation from the combustion gas obtained in the combustion unit 254, and functions as a separate heat source radiator that heats air by heat radiation from a heat source (here, heat from gas combustion) that is separate from the heat pump unit 360.

In the ventilation path from the air inflow port 232 to the air outflow port 231 formed in the housing 230, the furnace heat exchanger 255 is located on a windward side of the indoor heat exchanger 242 as a refrigerant radiator.

(1-3) Indoor Fan 240

The indoor fan 240 is a fan for supply, into the rooms 101 to 104, of air heated by the indoor heat exchanger 242 as a refrigerant radiator that constitutes the heat pump unit 360, and the furnace heat exchanger 255 as a separate heat source radiator that constitutes the separate heat source unit 270.

In the ventilation path from the air inflow port 232 to the air outflow port 231 formed in the housing 230, the indoor fan 240 is located on a windward side of both the indoor heat exchanger 242 and the furnace heat exchanger 255. The indoor fan 240 has a blade 243 and a fan motor 244 that drives the blade 243 to rotate.

(1-4) Controller 30

The indoor unit 2 is equipped with an indoor-side control board 21 that controls an operation of each part of the indoor unit 2. The outdoor unit 3 is equipped with an outdoor-side control board 31 that controls an operation of each part of the outdoor unit 3. Then, the indoor-side control board 21 and the outdoor-side control board 31 have a microcomputer or the like, and exchange control signals or the like with a thermostat 40. Further, the control signal is not exchanged between the indoor-side control board 21 and the outdoor-side control board 31. The control device including the indoor-side control board 21 and the outdoor-side control board 31 is called a controller 30.

(2) Detailed Structure of Controller 30

Figure 3:
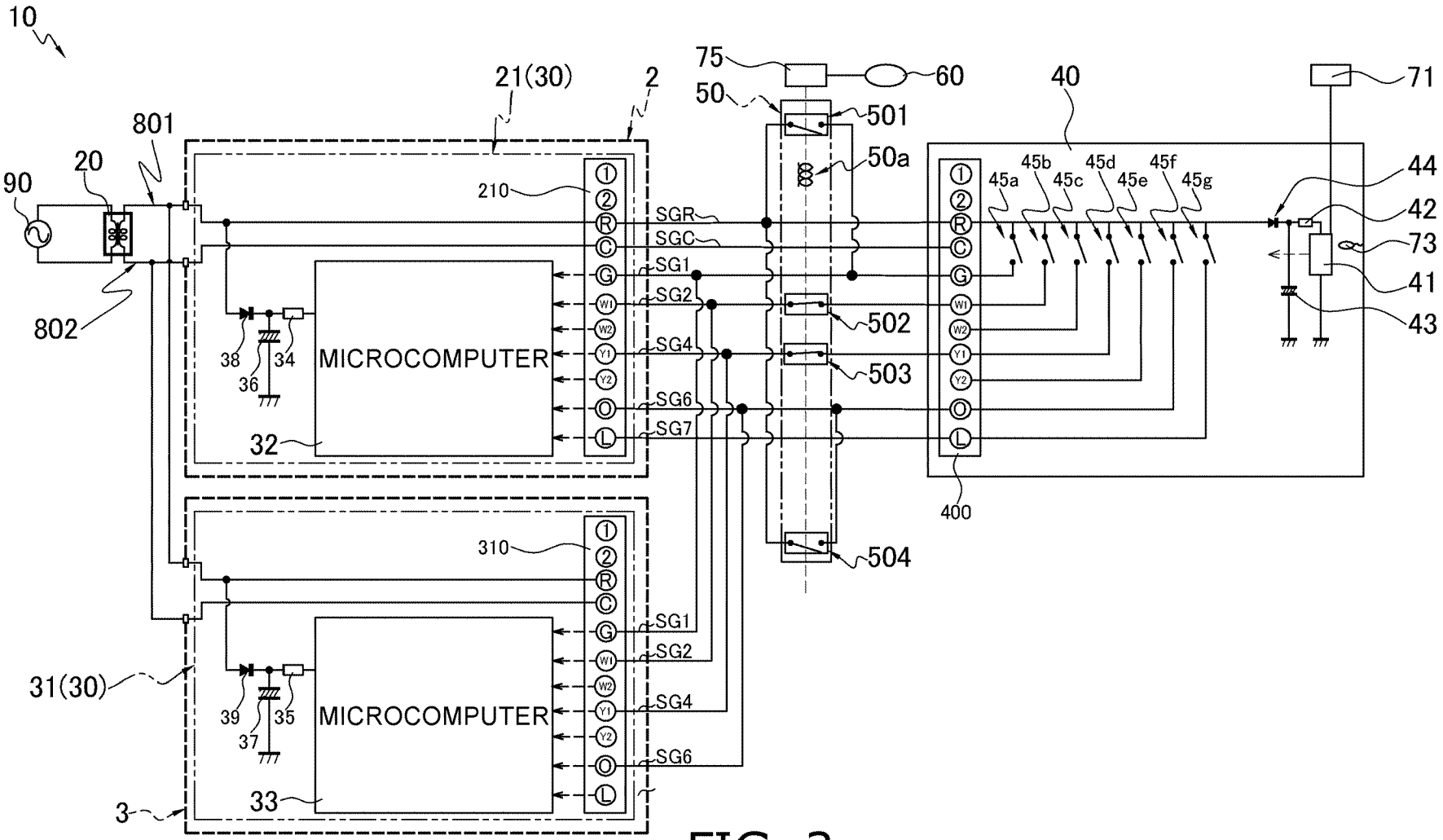
FIG. 3 is a block diagram showing an electrical connection state of a controller and a thermostat in an air conditioning system according to one or more embodiments of the present invention.

FIG. 3 is a block diagram showing an electrical connection state of the controller 30 and the thermostat 40 in the air conditioning system 1 according to one or more embodiments of the present invention. The thermostat 40 is attached in an indoor space in the same manner as the indoor unit 2. Note that a place where the thermostat 40 and the indoor unit 2 each are attached may be different places in the indoor space. Further, the thermostat 40 is connected to individual control systems of the indoor unit 2 and the outdoor unit 3 by a communication line.

A transformer 20 transforms a voltage of a commercial power source 90 to a usable low voltage, and then supplies to each of the indoor unit 2, the outdoor unit 3, and the thermostat 40 via power source lines 801 and 802.

(2-1) Indoor-Side Control Board 21

On the indoor-side control board 21, an indoor-side microcomputer 32, an indoor-side switching power source 34, an indoor-side capacitor 36, an indoor-side diode 38, and a terminal block 210 are mounted. On the terminal block 210, from the top in front view of FIG. 3, a first terminal, a second terminal, a terminal R, a terminal C, a terminal G, a terminal W1, a terminal W2, a terminal Y1, a terminal Y2, a terminal O, and a terminal L are sequentially arranged.

Note that, for convenience of explanation, in order to clarify that the terminals are those of the terminal block 210 of the indoor-side control board 21, the "first terminal", the "second terminal", the "terminal R", the "terminal C", the "terminal G", the "terminal W1", the "terminal W2", the "terminal Y1", the "terminal Y2", the "terminal O", and the "terminal L" are referred to as a "first terminal 1*i*", a "second terminal 2*i*", a "terminal Ri", a "terminal Ci", a "terminal Gi", a "terminal W1*i*", a "terminal W2*i*", a "terminal Y1*i*", a "terminal Y2*i*", a "terminal Oi", and a "terminal Li".

In the indoor-side control board 21, the terminal Ri and the power source line 801 are connected. In addition, the terminal Ci and the power source line 802 are connected. Furthermore, the terminal Gi, the terminal W1*i*, the terminal W2*i*, the terminal Y1*i*, the terminal Y2*i*, the terminal Oi, and the terminal Li are connected to the indoor-side microcomputer 32.

(2-1-1) Indoor-Side Microcomputer 32

To the indoor-side microcomputer 32, a plurality of command signals are inputted from the thermostat 40 to different input ports via a communication line.

In one or more embodiments, the indoor-side microcomputer 32 is connected to the thermostat 40 at least by a power supply line SGR, a common line SGC, a fan operation command communication line SG1 (second connection line), and a first compressor operation command communication line SG4 (first connection line).

Since 24 V AC is applied to each communication line, a converter (not illustrated) is connected between each input port of the indoor-side microcomputer 32 and each corresponding communication line, and a DC signal is inputted to each input port of the indoor-side microcomputer 32.

(2-1-2) Indoor-Side Switching Power Source 34

The indoor-side switching power source 34 is interposed between the power source line 801 and the indoor-side microcomputer 32, and converts supplied AC power to DC power.

(2-1-3) Indoor-Side Capacitor 36

The indoor-side capacitor 36 is a bypass capacitor that connects between GND and a power source line connecting the power source line 801 and the indoor-side switching power source 34, and maintains a supply potential to the indoor-side switching power source 34.

(2-1-4) Indoor-Side Diode 38

The indoor-side diode 38 is connected between the power source line 801 and a connection point of a positive electrode of the indoor-side capacitor 36, on a power source line connecting the power source line 801 and the indoor-side switching power source 34. A cathode of the indoor-side diode 38 is connected to a positive electrode side of the indoor-side capacitor 36, and an anode is connected to the power source line 801 side. The indoor-side diode 38 prevents an electric charge stored in the indoor-side capacitor 36 from flowing to the power source line 801 side when being discharged.

(2-2) Outdoor-Side Control Board 31

The outdoor unit 3 is equipped with the outdoor-side control board 31. On the outdoor-side control board 31, an outdoor-side microcomputer 33, an outdoor-side switching power source 35, an outdoor-side capacitor 37, an outdoor-side diode 39, and a terminal block 310 are mounted. On the terminal block 310, from the top in front view of FIG. 3, a first terminal, a second terminal, a terminal R, a terminal C, a terminal G, a terminal W1, a terminal W2, a terminal Y1, a terminal Y2, a terminal O, and a terminal L are sequentially arranged.

Note that, for convenience of explanation, in order to clarify that the terminals are those of the terminal block 310 of the outdoor-side control board 31, the "first terminal", the "second terminal", the "terminal R", the "terminal C", the "terminal G", the "terminal W1", the "terminal W2", the "terminal Y1", the "terminal Y2", the "terminal O", and the "terminal L" are referred to as a "first terminal 1*o*", a "second terminal 2*o*", a "terminal Ro", a "terminal Co", a "terminal Go", a "terminal W1*o*", a "terminal W2*o*", a "terminal Y1*o*", a "terminal Y2*o*", a "terminal Oo", and a "terminal Lo".

In the outdoor-side control board 31, the terminal Ro and the power source line 801 are connected. In addition, the terminal Co and the power source line 802 are connected. Further, the terminal Go, the terminal W1*o*, the terminal W2*o*, the terminal Y1*o*, the terminal Y2*o*, the terminal Oo, and the terminal Li are connected to the outdoor-side microcomputer 33.

(2-2-1) Outdoor-Side Microcomputer 33

Similarly to the indoor-side microcomputer 32, to the outdoor-side microcomputer 33, a plurality of command signals are inputted from the thermostat 40 to different input ports via a communication line.

In one or more embodiments, the outdoor-side microcomputer 33 is connected to the thermostat 40 at least by the first compressor operation command communication line SG4.

Since 24 V AC is applied to each communication line, a converter (not illustrated) is connected between each input port of the outdoor-side microcomputer 33 and each corresponding communication line, and a DC signal is inputted to each input port of the outdoor-side microcomputer 33.

(2-2-2) Outdoor-Side Switching Power Source 35

The outdoor-side switching power source 35 is interposed between the power source line 801 and the outdoor-side microcomputer 33, and converts supplied AC power to DC power.

(2-2-3) Outdoor-Side Capacitor 37

The outdoor-side capacitor 37 is a bypass capacitor that connects between GND and a power source line connecting the power source line 801 and the outdoor-side switching power source 35, and maintains a supply potential to the outdoor-side switching power source 35.

(2-2-4) Outdoor-Side Diode 39

The outdoor-side diode 39 is connected between the power source line 801 and a connection point of a positive electrode of the outdoor-side capacitor 37, on a power source line connecting the power source line 801 and the outdoor-side switching power source 35. A cathode of the outdoor-side diode 39 is connected to a positive electrode side of the outdoor-side capacitor 37, and an anode is connected to the power source line 801 side. The outdoor-side diode 39 prevents an electric charge stored in the outdoor-side capacitor 37 from flowing to the power source line 801 side when being discharged.

(3) Detailed Structure of Thermostat 40

The thermostat 40 is connected to the indoor-side control board 21 of the indoor unit 2 and the outdoor-side control board 31 of the outdoor unit 3 via a communication line. The thermostat 40 is installed in an air conditioning target space where the indoor unit 2 is installed.

The thermostat 40 includes a temperature control microcomputer 41, a temperature control switching power source 42, a temperature control capacitor 43, a temperature control diode 44, a fan operation command relay 45*a*, a first heating operation command relay 45*b*, a second heating operation command relay 45*c*, a first compressor operation command relay 45*d*, a second compressor operation command relay 45*e*, a reverse valve operation command relay an alarm command relay 45*g*, and a terminal block 400.

On the terminal block 400, from the top in front view of FIG. 3, a first terminal, a second terminal, a terminal R, a terminal C, a terminal G, a terminal W1, a terminal W2, a terminal Y1, a terminal Y2, a terminal O, and a terminal L are sequentially arranged.

Note that, for convenience of explanation, in order to clarify that the terminals are those of the terminal block 400 of the thermostat 40, the "first terminal", the "second terminal", the "terminal R", the "terminal C", the "terminal G", the "terminal W1", the "terminal W2", the "terminal Y1", the "terminal Y2", the "terminal O", and the "terminal L" are referred to as a "first terminal 1*t*", a "second terminal 2*t*", a "terminal Rt", a "terminal Ct", a "terminal Gt", a "terminal W1*t*", a "terminal W2*t*", a "terminal Y1*t*", a "terminal Y2*t*", a "terminal Ot", and a "terminal Lt".

The terminal Rt of the thermostat 40 and the power source line 801 are connected via the power supply line SGR. Further, the terminal Ct of the thermostat 40 and the power source line 802 are connected via the common line SGC.

(3-1) Temperature Control Microcomputer 41

The temperature control microcomputer 41 determines, for example, whether or not a difference between an indoor set temperature Ts set by a setting means 71 and an indoor temperature Tr detected by a temperature sensor 73 is within a predetermined range. Then, when it is determined that the difference is out of the predetermined temperature range, the temperature control microcomputer 41 turns ON the first compressor operation command relay or both the first compressor operation command relay 45*d* and the second compressor operation command relay 45*e*, to output an operation command signal to the air conditioner 10.

(3-2) Temperature Control Switching Power Source 42

The temperature control switching power source 42 is interposed between the transformer 20 and the temperature control microcomputer 41, and converts AC power supplied from the transformer 20 into a DC power source.

(3-3) Temperature Control Capacitor 43

The temperature control capacitor 43 is a bypass capacitor that connects between GND and a power source line connecting the transformer 20 and the temperature control switching power source 42, and maintains a supply potential to the temperature control switching power source 42.

(3-4) Temperature Control Diode 44

The temperature control diode 44 is connected between the transformer 20 and a connection point of a positive electrode of the temperature control capacitor 43, on the power source line connecting the transformer 20 and the temperature control switching power source 42. A cathode of the temperature control diode 44 is connected to a positive electrode side of the temperature control capacitor 43, and an anode is connected to the transformer 20 side. The temperature control diode 44 prevents an electric charge stored in the temperature control capacitor 43 from flowing to the transformer 20 side when being discharged.

(3-5) Fan Operation Command Relay 45*a*

The fan operation command relay 45*a* is connected so as to be able to conduct or cut off between the terminal Rt and the terminal Gt of the thermostat 40.

The terminal Gt of the thermostat 40, the terminal Gi of the indoor-side control board 21, and the terminal Go of the outdoor-side control board 31 are connected by the fan operation command communication line SG1.

When a user selects either a fan operation mode or a heating operation mode by the setting means 71, the fan operation command relay 45*a* turns ON by receiving a drive voltage from the temperature control microcomputer 41, and applies 24 V AC to the fan operation command communication line SG1.

(3-6) First Heating Operation Command Relay 45*b*

The first heating operation command relay 45*b* is connected so as to be able to conduct or cut off between the terminal Rt and the terminal W1*t* of the thermostat 40.

The terminal W1*t* of the thermostat 40, the terminal W1*i* of the indoor-side control board 21, and the terminal W1*o* of the outdoor-side control board 31 are connected by a first heating operation command communication line SG2 (fourth connection line).

When the user selects the heating operation mode by the setting means 71, and it is determined that the indoor temperature Tr detected by the temperature sensor 73 is lower than the indoor set temperature Ts set by the user from the setting means 71, the temperature control microcomputer 41 first performs a heat pump operation. Then, when switching the heat pump heating operation to a separate heat source heating operation in accordance with a decrease in the outside air temperature Ta, the temperature control microcomputer 41 applies a drive voltage to a drive coil of the first heating operation command relay 45*b*. The first heating operation command relay 45*b* turns ON by receiving the drive voltage from the temperature control microcomputer 41, and applies 24 V AC to the first heating operation command communication line SG2. At this time, the heat pump operation is stopped.

(3-7) Second Heating Operation Command Relay 45*c*

The second heating operation command relay 45*c* is connected so as to be able to conduct or cut off between the terminal Rt and the terminal W2*t* of the thermostat 40.

In performing a second heating operation, the terminal W2*t* of the thermostat 40, the terminal W2*i* of the indoor-side control board 21, and the terminal W2*o* of the outdoor-side control board 31 are connected by the second heating operation command communication line. However, since the second heating operation is not performed in one or more embodiments, the terminal W2*t* of the thermostat 40, the terminal W2*i* of the indoor-side control board 21, and the terminal W2*o* of the outdoor-side control board 31 are not connected.

(3-8) First Compressor Operation Command Relay 45*d*

The first compressor operation command relay 45*d* is connected so as to be able to conduct or cut off between the terminal Rt and the terminal Y1*t* of the thermostat 40.

The terminal Y1*t* of the thermostat 40, the terminal Y1*i* of the indoor-side control board 21, and the terminal Y1*o* of the outdoor-side control board 31 are connected by the first compressor operation command communication line SG4.

When the user selects the heating operation mode by the setting means 71, and it is determined that the indoor temperature Tr detected by the temperature sensor 73 is lower than the indoor set temperature Ts set by the user from the setting means 71, the temperature control microcomputer 41 applies a drive voltage to a drive coil of the first compressor operation command relay 45*d*.

The first compressor operation command relay 45*d* turns ON by receiving the drive voltage from the temperature control microcomputer 41, and applies 24 V AC to the first compressor operation command communication line SG4.

(3-9) Second Compressor Operation Command Relay 45*e*

The second compressor operation command relay 45*e* is connected so as to be able to conduct or cut off between the terminal Rt and the terminal Y2*t* of the thermostat 40.

In operating the second compressor, the terminal Y2*t* of the thermostat 40, the terminal Y2*i* of the indoor-side control board 21, and the terminal Y2*o* of the outdoor-side control board 31 are connected by a second compressor operation command communication line. However, since the second compressor is not operated in one or more embodiments, the terminal Y2*t* of the thermostat 40, the terminal Y2*i* of the indoor-side control board 21, and the terminal Y2*o* of the outdoor-side control board 31 are not connected.

(3-10) Reverse Valve Operation Command Relay 45*f*

The reverse valve operation command relay 45*f* is connected so as to be able to conduct or cut off between the terminal Rt and the terminal Ot of the thermostat 40.

In operating a reverse valve, the terminal Ot of the thermostat 40, the terminal Oi of the indoor-side control board 21, and the terminal Oo of the outdoor-side control board 31 are connected by a reverse valve operation command communication line SG6 (third connection line) (see FIG. 3).

(3-11) Alarm Command Relay 45*g*

The alarm command relay 45*g* is connected so as to be able to conduct or cut off between the terminal Rt and the terminal Lt of the thermostat 40.

Figure 6:
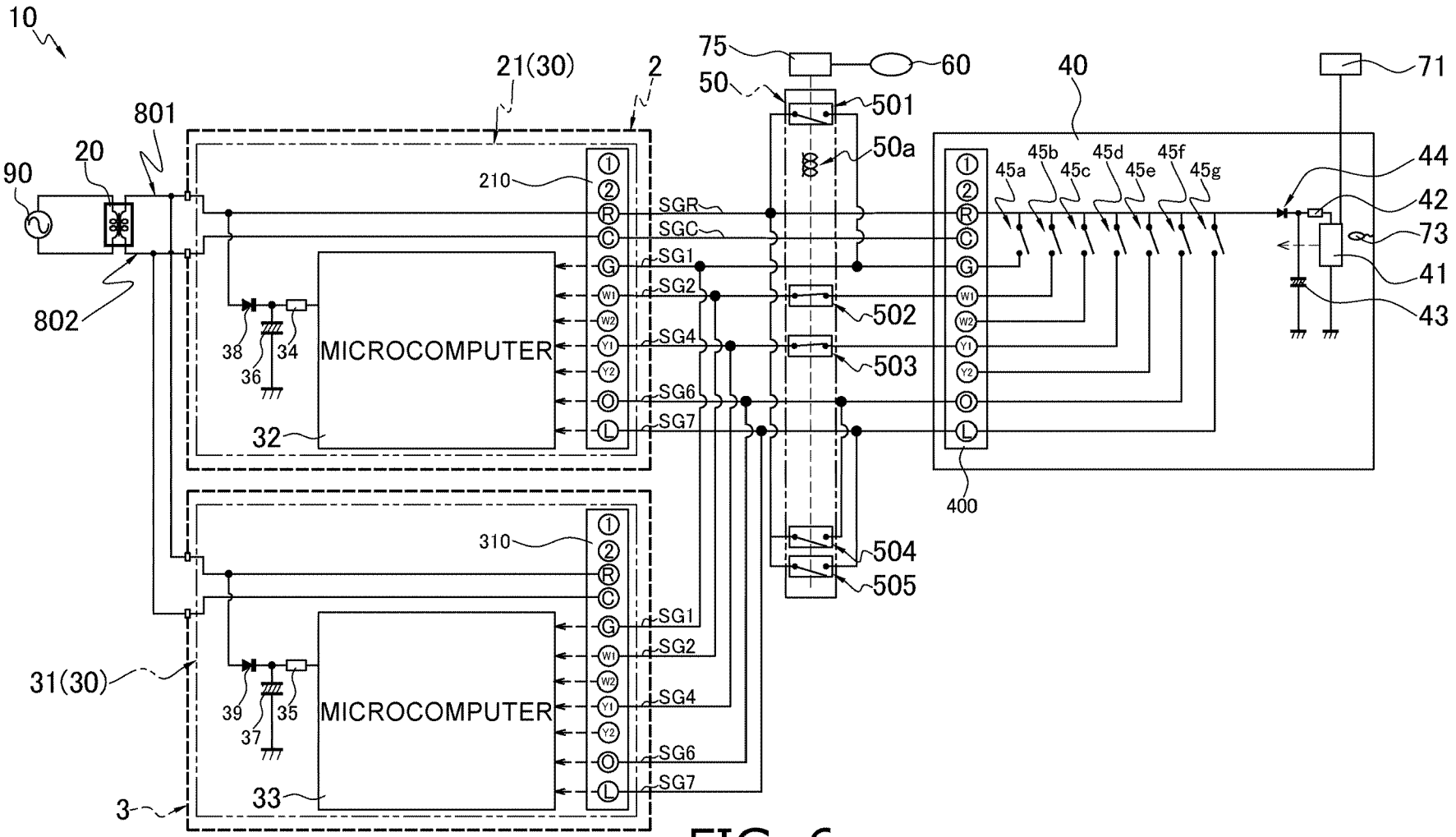
FIG. 6 is a block diagram showing an electrical connection state of a controller and a thermostat in an air conditioning system according to a modified example of one or more embodiments of the present invention.

In operating an alarm, the terminal Lt of the thermostat 40, the terminal Li of the indoor-side control board 21, and the terminal Lo of the outdoor-side control board 31 are connected by an alarm command communication line SG7 (fifth connection line) (see FIG. 6). However, since the alarm is not operated in one or more embodiments, the terminal Lt of the thermostat 40, the terminal Li of the indoor-side control board 21, and the terminal Lo of the outdoor-side control board 31 are not connected.

(3-12) Communication Line Conduction and Cut-Off Relay 50

A communication line conduction and cut-off relay 50 has a first contact point 501, a second contact point 502, a third contact point 503, and a fourth contact point 504 that are opened and closed by energization of a coil 50*a*. Energization to the coil 50*a* is controlled by controlling energization from a relay controller 75.

The first contact point 501 is a normally open contact point, and is connected in parallel with the fan operation command relay 45*a*, that is, connected so as to be able to conduct or cut off between the terminal Rt and the terminal Gt of the thermostat 40.

The second contact point 502 is a normally closed contact point, and is connected in series with the first heating operation command communication line SG2, that is, connected so as to be able to conduct or cut off the first heating operation command communication line SG2.

The third contact point 503 is a normally closed contact point, and is connected in series to the first compressor operation command communication line SG4, that is, connected so as to be able to conduct or cut off the first compressor operation command communication line SG4.

The fourth contact point 504 is a normally open contact point, and is connected in parallel with the reverse valve operation command relay 45*f*, that is, connected so as to be able to conduct or cut off between the terminal Rt and the terminal Ot of the thermostat 40.

(3-13) Leakage Detection Sensor 60

When a refrigerant leaks from the refrigerant circuit 320 of the heat pump unit 360, the leakage detection sensor 60 detects the leaked refrigerant, and outputs a detection signal to the relay controller 75. The refrigerant sealed in the refrigerant circuit 320 is a flammable refrigerant, and R32 is used in one or more embodiments. The leakage detection sensor 60 is installed in an air conditioning target space where the indoor unit 2 is installed.

(3-14) Setting Means 71

The setting means 71 is provided with at least an operating mode selection unit (not illustrated) and an indoor temperature setting unit (not illustrated). The operating mode selection unit may have a configuration for, for example, determining the fan operation mode and the heating operation mode by a selection button. The indoor temperature setting unit may be, for example, a button or dial configuration for increasing or decreasing a set temperature.

(4) Basic Operation of Air Conditioning System

An air conditioning operation of the air conditioning system 1 includes a fan operation, a cooling operation, and a heating operation. Here, a basic operation of the heating operation will be described with reference to FIGS. 1 to 3. The heating operation of the air conditioning system 1 includes a heat pump heating operation for heating a room with the heat pump unit 360, and a separate heat source heating operation for heating a room with the separate heat source unit 270.

(4-1) Heat Pump Heating Operation

In the heat pump heating operation, the refrigerant in the refrigerant circuit 320 is suctioned into the compressor 321, and compressed to become a high-pressure gas refrigerant. This high-pressure gas refrigerant is sent from the outdoor unit 3 to the indoor unit 2 via the gas-refrigerant connection pipe 307.

The high-pressure gas refrigerant sent to the indoor unit 2 is sent to the indoor heat exchanger 242 as a refrigerant radiator. The high-pressure gas refrigerant sent to the indoor heat exchanger 242 is cooled by heat exchange in the indoor heat exchanger 242 with indoor air F1 (F2) supplied by the indoor fan 240, to be condensed to become a high-pressure liquid refrigerant.

This high-pressure liquid refrigerant is sent from the indoor unit 2 to the outdoor unit 3 via the indoor expansion valve 241 and a liquid-refrigerant connection pipe 306. Whereas, indoor air F3 heated in the indoor heat exchanger 242 is sent from the indoor unit 2 to the individual rooms 101 to 104 through the duct 209, for heating.

The high-pressure liquid refrigerant sent to the outdoor unit 3 is sent to the outdoor expansion valve 324, and decompressed by the outdoor expansion valve 324 to become a low-pressure refrigerant in a gas-liquid two-phase state. This low-pressure refrigerant in the gas-liquid two-phase state is sent to the outdoor heat exchanger 323 as a refrigerant evaporator.

The low-pressure refrigerant in the gas-liquid two-phase state sent to the outdoor heat exchanger 323 is heated by heat exchange in the outdoor heat exchanger 323 with outdoor air supplied by the outdoor fan 325, to evaporate to become a low-pressure gas refrigerant. This low-pressure gas refrigerant is suctioned into the compressor 321 again.

Then, in the heat pump heating operation described above, the outdoor-side microcomputer 33 of the controller 30 controls the indoor temperature Tr in the rooms 101 to 104 to reach the indoor set temperature Ts, by controlling an operating capacity Gr of the compressor 321 and by controlling an opening degree V of the outdoor expansion valve 324.

(4-2) Separate Heat Source Heating Operation

In the separate heat source heating operation, high-temperature combustion gas is generated by opening the fuel gas valve 251 to supply fuel gas to the combustion unit 254, mixing in the combustion unit 254 the fuel gas with air taken into the gas furnace unit 205 via the air supply pipe 256 by the furnace fan 252, and igniting the fuel gas to burn.

The high-temperature combustion gas generated in the combustion unit 254 is sent to the furnace heat exchanger 255 as a separate heat source radiator. The high-temperature combustion gas sent to the furnace heat exchanger 255 is cooled by heat exchange in the furnace heat exchanger 255 with the indoor air F1 supplied by the indoor fan 240, to become low-temperature combustion gas. This low-temperature combustion gas is discharged from the gas furnace unit 205 via the exhaust pipe 257. Whereas, the indoor air F2 (F3) heated in the furnace heat exchanger 255 is sent from the indoor unit 2 to the individual rooms 101 to 104 through the duct 209, for heating.

Then, in the separate heat source heating operation described above, the indoor-side microcomputer 32 of the controller 30 controls the indoor temperature Tr in the rooms 101 to 104 to reach the indoor set temperature Ts, by controlling opening and closing of the fuel gas valve 251.

Specifically, the indoor-side microcomputer 32 of the controller 30 controls to open the fuel gas valve 251 when a temperature difference obtained by subtracting the indoor set temperature Ts from the indoor temperature Tr becomes large, and to close the fuel gas valve 251 when the temperature difference becomes small (4-3) Switching Operation Between Heat Pump Heating Operation and Separate Heat Source Heating Operation In the air conditioning system 1, when the outside air temperature Ta is very low, the heat pump heating operation may not be able to cover an air conditioning load (a heating load) in a room (here, the rooms 101 to 104). Therefore, the heat pump heating operation is switched to the separate heat source heating operation in accordance with a decrease in the outside air temperature Ta. Further, on the contrary, the separate heat source heating operation is switched to the heat pump heating operation in accordance with an increase of the outside air temperature Ta.

Specifically, when an operation of the air conditioning system 1 starts, first, the heat pump heating operation is performed. Then, when the outside air temperature Ta during the heat pump heating operation reaches a first temperature Ta1 or less, and a heating capacity of the heat pump unit 360 reaches an upper limit, the heat pump heating operation is switched to the separate heat source heating operation.

Note that, whether or not an operating capacity of equipment included in the heat pump unit 360 has reached the upper limit is determined by whether or not a number N of revolutions of the compressor motor 322 has reached an upper limit number Nu of revolutions, and/or whether or not the opening degree V of the outdoor expansion valve 324 has reached an upper limit opening degree Vu.

Whereas, in the separate heat source heating operation, the separate heat source heating operation is switched to the heat pump heating operation, when the outside air temperature Ta during the separate heat source heating operation reaches a second temperature Ta2 or higher.

(5) Control Operation of Air Conditioning System 1

Figure 4A:
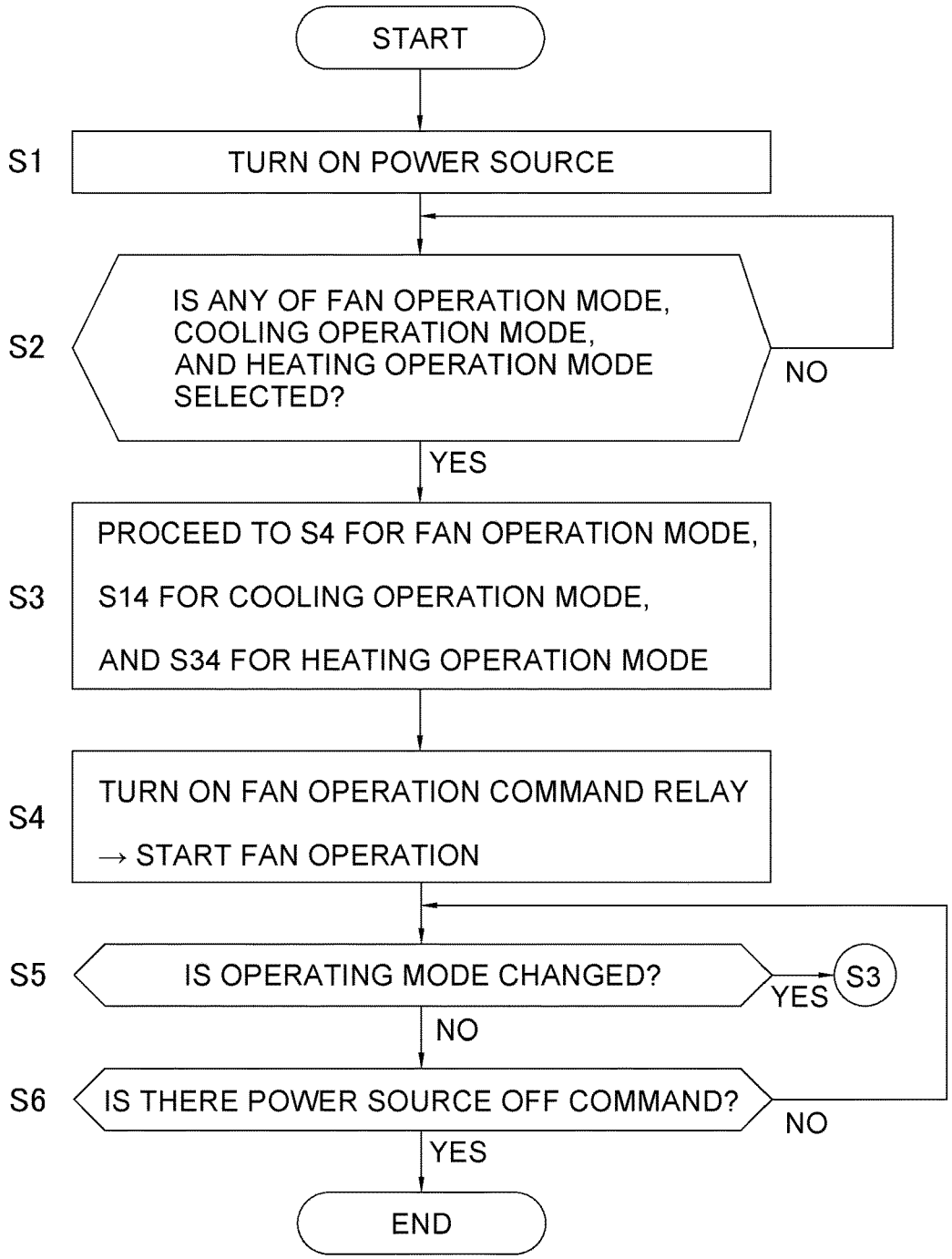
FIG. 4A is a control flow chart of the air conditioning system according to one or more embodiments of the present invention.
Figure 4B:
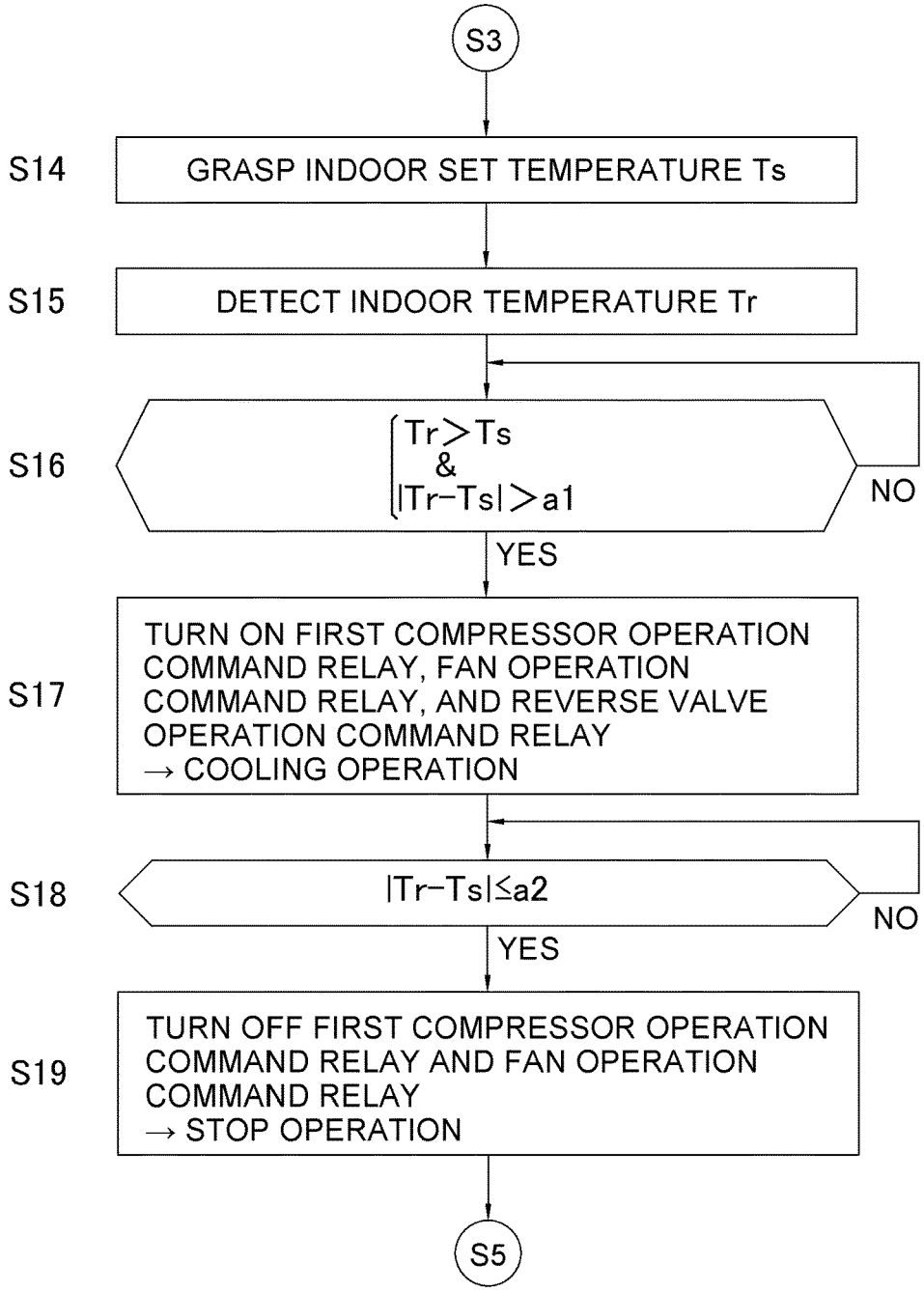
FIG. 4B is a control flow chart of the air conditioning system after a cooling operation mode is selected according to one or more embodiments of the present invention.
Figure 4C:
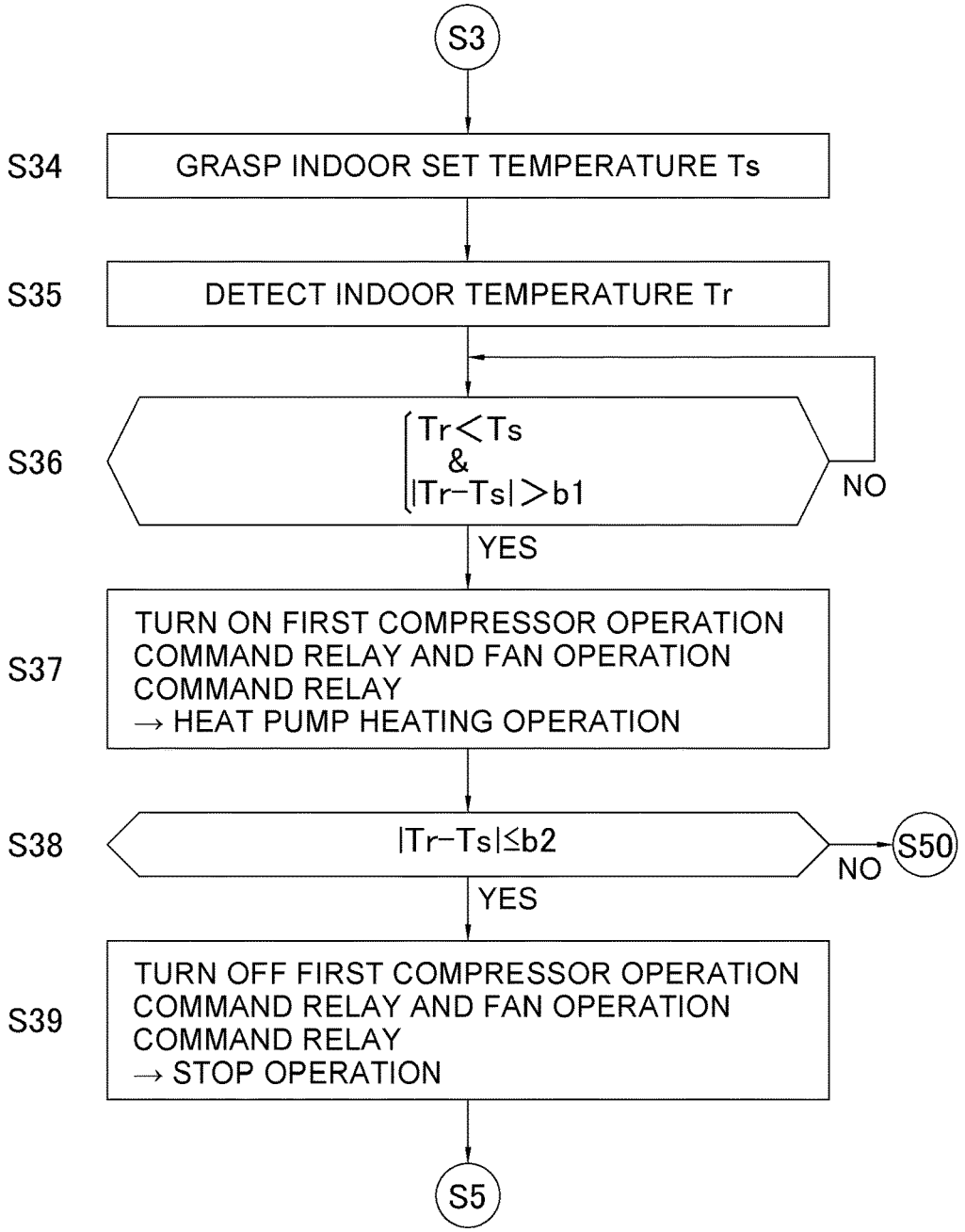
FIG. 4C is a control flow chart of the air conditioning system after a heating operation mode is selected according to one or more embodiments of the present invention.
Figure 4D:
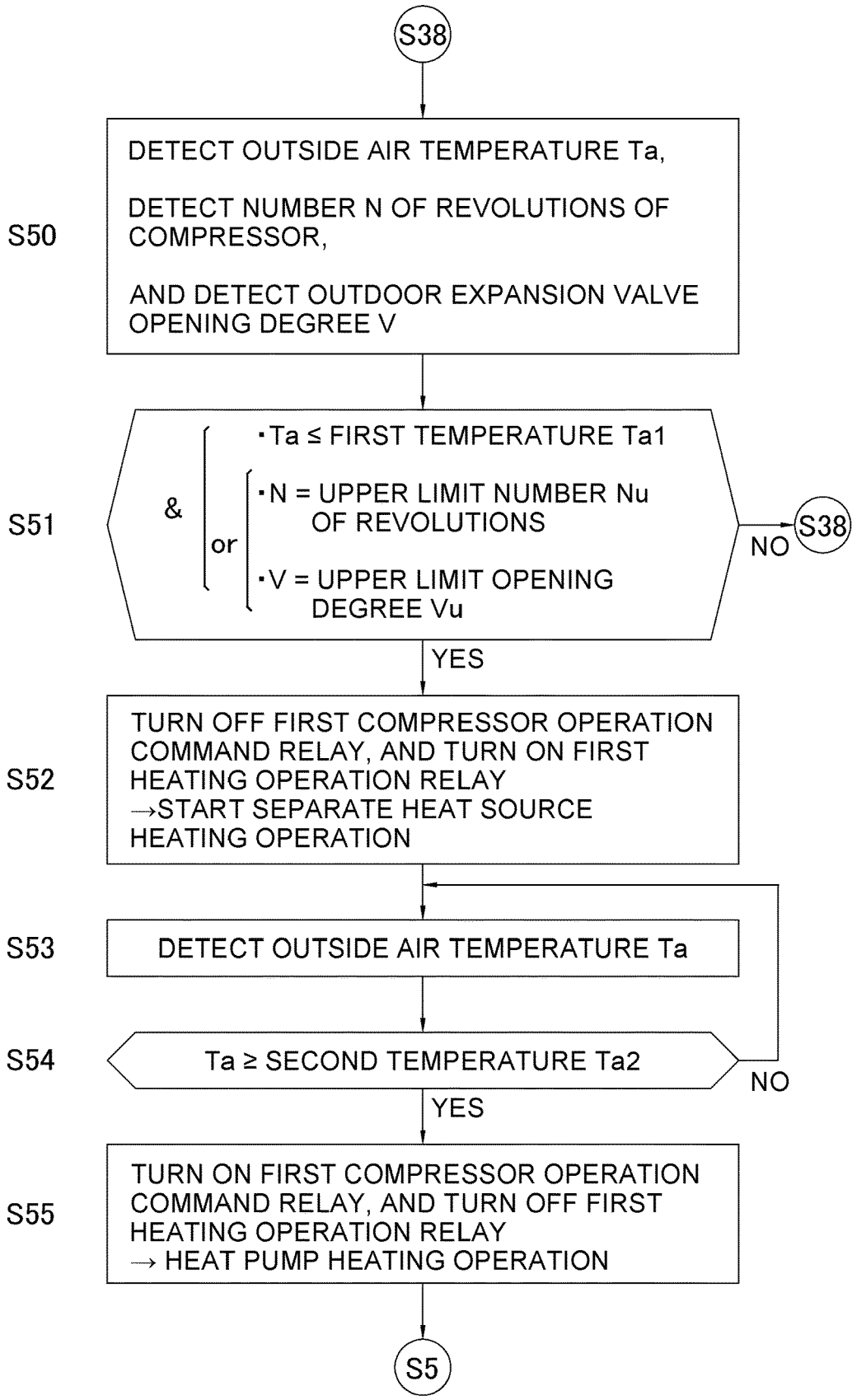
FIG. 4D is a control flow chart of the air conditioning system after the heating operation mode is selected, and is a flow chart of control to switch from a heat pump heating operation to a separate heat source heating operation according to one or more embodiments of the present invention.

Hereinafter, an operation of the air conditioning system 1 will be described with reference to a control flow chart. FIG. 4A is a control flow chart of the air conditioning system 1. Further, FIG. 4B is a control flow chart of the air conditioning system 1 after a cooling operation mode is selected. Furthermore, FIG. 4C is a control flow chart of the air conditioning system 1 after a heating operation mode is selected. Moreover, FIG. 4D is a control flow chart of the air conditioning system 1 after the heating operation mode is selected, and is a flow chart of control to switch from the heat pump heating operation to the separate heat source heating operation.

(Steps S1 and S2)

When a power source of the temperature control microcomputer 41 is turned ON in step S1, the process proceeds to step S2, and the temperature control microcomputer 41 determines whether or not an operating mode is selected.

(Step S3)

Next, in step S3, the temperature control microcomputer 41 determines a routine for each operating mode. Here, the process proceeds to step S4 when the fan operation mode is determined by the temperature control microcomputer 41, the process proceeds to step S14 when the cooling operation mode is determined, and the process proceeds to step S34 when the heating operation mode is determined.

(5-1) Control of Fan Operation

Hereinafter, control of a fan operation will be described with reference to FIG. 4A.

(Step S4)

The temperature control microcomputer 41 turns ON the fan operation command relay in step S4. As a result, 24 V AC is applied to the fan operation command communication line SG1. At this time, the indoor-side microcomputer 32 operates the indoor fan 240 (see FIG. 2) of the indoor unit 2 for the fan operation.

(Step S5)

Next, the temperature control microcomputer 41 determines in step S5 whether or not the operating mode has been changed. When it is determined that "the operating mode has been changed", the process returns to step S3. When it is determined that "the operating mode has not been changed", the process proceeds to step S6.

(Step S6)

Next, in step S6, the temperature control microcomputer 41 determines the presence or absence of a power source off command. When it is determined that "there is no power source off command", the process returns to step S5. When it is determined that "there is a power source off command", the control is terminated.

(5-2) Control of Cooling Operation

Hereinafter, control of a cooling operation will be described with reference to FIG. 4B.

(Step S14)

When the cooling operation mode is selected, the process proceeds to step S14, the temperature control microcomputer 41 grasps the indoor set temperature Ts, and the process proceeds to step S15.

(Step S15)

Next, the temperature control microcomputer 41 detects the indoor temperature Tr in step S15, and the process proceeds to step S16.

(Step S16)

Next, the temperature control microcomputer 41 determines in step S16 whether or not the indoor temperature Tr is larger than the indoor set temperature Ts, and an absolute value of a difference between the indoor temperature Tr and the indoor set temperature Ts is larger than a predetermined threshold value a1. When the condition is satisfied, the process proceeds to step S17, and when the condition is not satisfied, the determination is continued.

(Step S17)

Next, in step S17, the temperature control microcomputer 41 turns ON the fan operation command relay 45*a*, the first compressor operation command relay 45*d*, and the reverse valve operation command relay 45*f*. As a result, 24 V AC is applied to the fan operation command communication line SG1, the first compressor operation command communication line SG4, and the reverse valve operation command communication line SG6.

In the cooling operation, air cooled by the indoor heat exchanger 242 is conveyed into a room through the duct 209 by operation of the indoor fan 240. Note that, in this cooling operation, the cooling operation is performed only by a command signal from the thermostat 40, without mutual communication between the indoor-side microcomputer 32 and the outdoor-side microcomputer 33.

(Step S18)

Next, in step S18, the temperature control microcomputer 41 determines whether or not an absolute value of a difference between the indoor temperature Tr and the indoor set temperature Ts reaches a predetermined threshold value a2 or less. The process proceeds to step S19 when $|Tr-Ts| \leq a2$ is determined, and temperature monitoring for the determination is continued when $|Tr-Ts| > a2$ is determined. Note that, there is a relationship of $a1 > a2$ between the threshold value a1 and the threshold value a2.

(Step S19)

Next, in step S19, the temperature control microcomputer 41 estimates that the indoor temperature Tr has reached the indoor set temperature Ts from the result of $|Tr-Ts| \leq a2$ in step S17, and turns OFF the first compressor operation command relay 45*d* and the fan operation command relay 45*a*.

As a result, 24 V AC is no longer applied to the first compressor operation command communication line SG4 and the fan operation command communication line SG1, and the cooling operation is stopped.

Next, the process proceeds to step S5, and the temperature control microcomputer 41 determines whether or not the operating mode has been changed. When it is determined that "the operating mode has been changed", the process returns to step S3. When it is determined that "the operating mode has not been changed", the process proceeds to step S6.

Next, in step S6, the temperature control microcomputer 41 determines the presence or absence of a power source off command. When it is determined that "there is no power source off command", the process returns to step S5. When it is determined that "there is a power source off command", the control is terminated.

(5-3) Control of Heating Operation

When the heating operation mode is selected, the heat pump heating operation is performed first, and the separate heat source heating operation is performed when a heating load cannot be handled even by performing the heat heating operation. Hereinafter, the heat pump heating operation and the separate heat source heating operation will be described separately with reference to FIGS. 4C and 4D.

(5-3-1) Control of Heat Pump Heating Operation (Step S34)

When the heating operation mode is selected, the process proceeds to step S34, the temperature control microcomputer 41 grasps the indoor set temperature Ts, and the process proceeds to step S35.

(Step S35)

Next, the temperature control microcomputer 41 detects the indoor temperature Tr in step S35, and the process proceeds to step S36.

(Step S36)

Next, the temperature control microcomputer 41 determines in step S36 whether or not the indoor temperature Tr is smaller than the indoor set temperature Ts, and whether or not an absolute value of a difference between the indoor temperature Tr and the indoor set temperature Ts is larger than a predetermined threshold value b1. When the condition is satisfied, the process proceeds to step S37, and when the condition is not satisfied, the determination is continued.

(Step S37)

Next, in step S37, the temperature control microcomputer 41 turns ON the fan operation command relay 45*a* and the first compressor operation command relay 45*d*. As a result, 24 V AC is applied to the fan operation command communication line SG1 and the first compressor operation command communication line SG4.

In the heat pump heating operation, air is heated by the indoor heat exchanger 242, and is conveyed into a room through the duct 209 by the operation of the indoor fan 240. Note that, in this heat pump operation, the heating operation is performed only by a command signal from the thermostat 40, without mutual communication between the indoor-side microcomputer 32 and the outdoor-side microcomputer 33.

(Step S38)

Next, in step S38, the temperature control microcomputer 41 determines whether or not an absolute value of a difference between the indoor temperature Tr and the indoor set temperature Ts reaches a predetermined threshold value b2 or less. The process proceeds to step S39 when $|Tr-Ts| \leq b2$ is determined, and the process proceeds to step S50 when $|Tr-Ts| > b2$ is determined. Note that, there is a relationship of $b1 > b2$ between the threshold value b1 and the threshold value b2.

(Step S39)

Next, in step S39, the temperature control microcomputer 41 estimates that the indoor temperature Tr has reached the indoor set temperature Ts from the result of $|Tr-Ts| \leq b2$ in step S37, and turns OFF the first compressor operation command relay 45*d* and the fan operation command relay 45*a*.

As a result, 24 V AC is no longer applied to the first compressor operation command communication line SG4 and the fan operation command communication line SG1, and the heating operation is stopped.

Next, the process proceeds to step S5, and the temperature control microcomputer 41 determines whether or not the operating mode has been changed. When it is determined that "the operating mode has been changed", the process returns to step S3. When it is determined that "the operating mode has not been changed", the process proceeds to step S6.

Next, in step S6, the temperature control microcomputer 41 determines the presence or absence of a power source off command. When it is determined that "there is no power source off command", the process returns to step S5. When it is determined that "there is a power source off command", the control is terminated.

(5-3-2) Control of Separate Heat Source Heating Operation (Step S50)

When the temperature control microcomputer 41 determines $|Tr-Ts| > b2$ in step S38, and the process proceeds to step S50, the temperature control microcomputer 41 detects, in step S50, the outside air temperature Ta, a number N of revolutions of the compressor, and the outdoor expansion valve opening degree V, and the process proceeds to step S51.

(Step S51)

Next, in step S51, the temperature control microcomputer 41 determines whether or not the outside air temperature Ta has reached the first temperature Ta1 or less, and whether or not the heating capacity by the heat pump unit 360 has reached the upper limit.

Here, whether or not an operating capacity of equipment included in the heat pump unit 360 has reached the upper limit is determined by whether or not a number N of revolutions of the compressor motor 322 has reached an upper limit number Nu of revolutions, or whether or not the opening degree V of the outdoor expansion valve 324 has reached the upper limit opening degree Vu.

Note that, whether or not an operating capacity of equipment included in the heat pump unit 360 has reached the upper limit may be determined by whether or not a number N of revolutions of the compressor motor 322 has reached the upper limit number Nu of revolutions, and whether or not the opening degree V of the outdoor expansion valve 324 has reached the upper limit opening degree Vu.

In step S51, when the temperature control microcomputer 41 determines that the outside air temperature Ta has reached the first temperature Ta1 or less, and the heating capacity by the heat pump unit 360 has reached the upper limit, the process proceeds to step S52, otherwise the process returns to step S38.

(Step S52)

Next, in step S52, the temperature control microcomputer 41 turns OFF the first compressor operation command relay 45*d*, and turns ON the first heating operation command relay 45*b*. As a result, 24 V AC is applied to the first heating operation command communication line SG2, and the separate heat source heating operation is performed.

Also in this separate heat source heating operation, air is heated by the furnace heat exchanger 255 and is conveyed into a room through the duct 209 by the operation of the indoor fan 240. Note that, also in this separate heat source heating operation, the heating operation is performed only by a command signal from the thermostat 40, without mutual communication between the indoor-side microcomputer 32 and the outdoor-side microcomputer 33.

(Step S53)

Next, in step S53, the temperature control microcomputer 41 detects the outside air temperature Ta, and the process proceeds to step S54.

(Step S54)

Next, in step S54, the temperature control microcomputer 41 determines whether or not the outside air temperature Ta has reached the second temperature Ta2 or higher. The process proceeds to step S55 when the outside air temperature Ta has reached the second temperature Ta2 or higher, and the process returns to step S53 when the outside air temperature Ta has not reached the second temperature Ta2 or higher.

(Step S55)

Next, in step S55, the temperature control microcomputer 41 turns ON the first compressor operation command relay 45*d*, and turns OFF the first heating operation command relay 45*b*.

As a result, since 24 V AC is applied to the first compressor operation command communication line SG4, and 24 V AC is no longer applied to the first heating operation command communication line SG2, the separate heat source heating operation is switched to the heat pump heating operation.

Next, the process proceeds to step S5, and the temperature control microcomputer 41 determines whether or not the operating mode has been changed. When it is determined that "the operating mode has been changed", the process returns to step S3. When it is determined that "the operating mode has not been changed", the process proceeds to step S6.

Next, in step S6, the temperature control microcomputer 41 determines the presence or absence of a power source off command. When it is determined that "there is no power source off command", the process returns to step S5. When it is determined that "there is a power source off command", the control is terminated.

(6) Operation of Air Conditioning System 1 after Refrigerant Leakage Detection In the air conditioning system 1, the compressor 321 or the gas furnace unit 205 is operated only by the ON or OFF signal from the thermostat 40. In addition, since the thermostat 40 does not have a function of detecting refrigerant leakage, the thermostat 40 cannot take appropriate refrigerant leakage measures even if there is a sign of refrigerant leakage.

One or more embodiments of the present invention are configured to be able to take appropriate refrigerant leakage measures by using the communication line conduction and cut-off relay 50 when refrigerant leakage is detected from the refrigerant circuit, regardless of the control signal of the thermostat 40.

Figure 5:
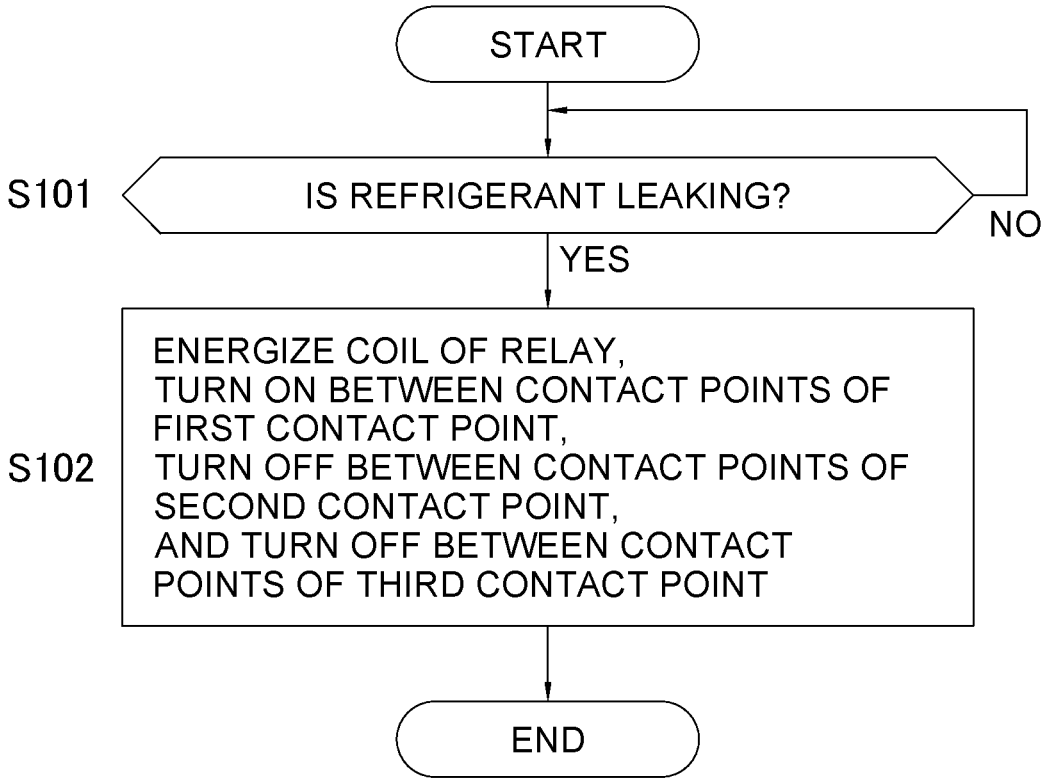
FIG. 5 is an operation flow chart of a communication line conduction and cut-off relay by a relay controller according to one or more embodiments of the present invention.

FIG. 5 is an operation flow chart of the communication line conduction and cut-off relay 50 by the relay controller 75. Hereinafter, an operation of the air conditioning system 1 after refrigerant leakage detection will be described with reference to FIG. 5.

(Step S101)

In FIGS. 3 and 5, the relay controller 75 determines the presence or absence of refrigerant leakage in step S101. The presence or absence of refrigerant leakage is determined by an output signal of the leakage detection sensor 60. The leakage detection sensor 60 outputs a voltage value less than a predetermined value when the refrigerant is not detected, but outputs a voltage value exceeding the predetermined value when the refrigerant is detected.

The relay controller 75 always takes in the output voltage from the leakage detection sensor 60 as a detection value, and determines that a refrigerant leaks when the detected value exceeds the predetermined value. When the relay controller 75 determines that "the refrigerant leaks", the process proceeds to step S102.

(Step S102)

Next, the relay controller 75 energizes the coil 50*a* of the communication line conduction and cut-off relay 50, and turns ON between the contact points of the first contact point 501, and turns OFF between the contact points of the second contact point 502 and between the contact points of the third contact point 503. The coil 50*a* is energized regardless of whether or not there is actual operation of the air conditioning system 1, that is, regardless of whether or not the compressor 321 is operated or the gas furnace unit 205 is operated.

The contact points of the first contact point 501 are connected such that the terminals Rt and Gt of the thermostat 40 can be conducted, but are normally in an open state. For example, if the refrigerant leaks when the fan operation command relay 45*a* is OFF, that is, when the indoor fan 240 is stopped, the leaked refrigerant may stay in the room.

Therefore, by turning ON between the contact points of the first contact point 501 to allow 24 V AC to be applied to the fan operation command communication line SG1, the indoor-side microcomputer 32 determines as a control signal from the thermostat 40 and operates the indoor fan 240. Operation of the indoor fan 240 causes the leaked refrigerant to be diffused and dilutes concentration, allowing a safe state to be ensured.

Further, the contact points of the second contact point 502 is connected so as to be able to conduct or cut off the first heating operation command communication line SG2, but is normally in a closed state. For example, if the refrigerant leaks when the first heating operation command relay 45*b* is ON, that is, during operation of the gas furnace unit 205, flame of the combustion unit 254 may ignite the leaked refrigerant.

Therefore, by turning OFF between the contact points of the second contact point 502 to disable application of 24 V AC to the first heating operation command communication line SG2, the indoor-side microcomputer 32 determines as a stop signal from the thermostat 40 and stops the operation of the gas furnace unit 205. Stopping the operation of the gas furnace unit 205 eliminates a possibility that flame of the combustion unit 254 ignites the leaked refrigerant, allowing a safe state to be ensured.

Further, the contact points of the third contact point 503 is connected so as to be able to conduct or cut off the first compressor operation command communication line SG4, but is normally in a closed state. For example, if the refrigerant leaks when the first compressor operation command relay 45*d* is ON, that is, during operation of the compressor 321, more refrigerant may be leaked into the room.

Therefore, by turning OFF between the contact points of the third contact point 503 to disable application of 24 V AC to the first compressor operation command communication line SG4, the indoor-side microcomputer 32 determines as a stop signal from the thermostat 40 and stops the operation of the compressor 321. Stopping the operation of the compressor 321 eliminates the possibility of leakage of more refrigerant into the room, allowing a safe state to be ensured.

(7) Characteristics

When it is determined that the refrigerant is leaking via the leakage detection sensor the relay controller 75 operates the communication line conduction and cut-off relay 50 regardless of the control signal of the thermostat 40, to stop the operation of the compressor 321 or the operation of the gas furnace unit 205 and operate the indoor fan 240.

This can prevent leakage of more refrigerant into the room, or prevent flame of the combustion unit 254 of the gas furnace unit 205 from igniting to the leaked refrigerant, quickly diffuse the leaked refrigerant staying in the room, dilute the concentration of the leaked refrigerant, and ensure a safe state.

(8) Modified Example

FIG. 6 is a block diagram showing an electrical connection state of a controller 30 and a thermostat 40 in an air conditioning system 1 according to a modified example.

In FIG. 6, a terminal Lt of the thermostat 40, a terminal Li of an indoor-side control board 21, and a terminal Lo of an outdoor-side control board 31 are connected by an alarm command communication line SG7.

A communication line conduction and cut-off relay 50 further has a fifth contact point 505, in addition to a first contact point 501, a second contact point 502, a third contact point 503, and a fourth contact point 504.

The fifth contact point 505 is a normally open contact point, and is connected in parallel with an alarm command relay 45*g*, that is, connected so as to be able to conduct or cut off between the terminal Rt and the terminal Lt of the thermostat 40.

The configuration other than the above is the same as that in FIG. 3.

(8-1) First Modified Example

Figure 7A:
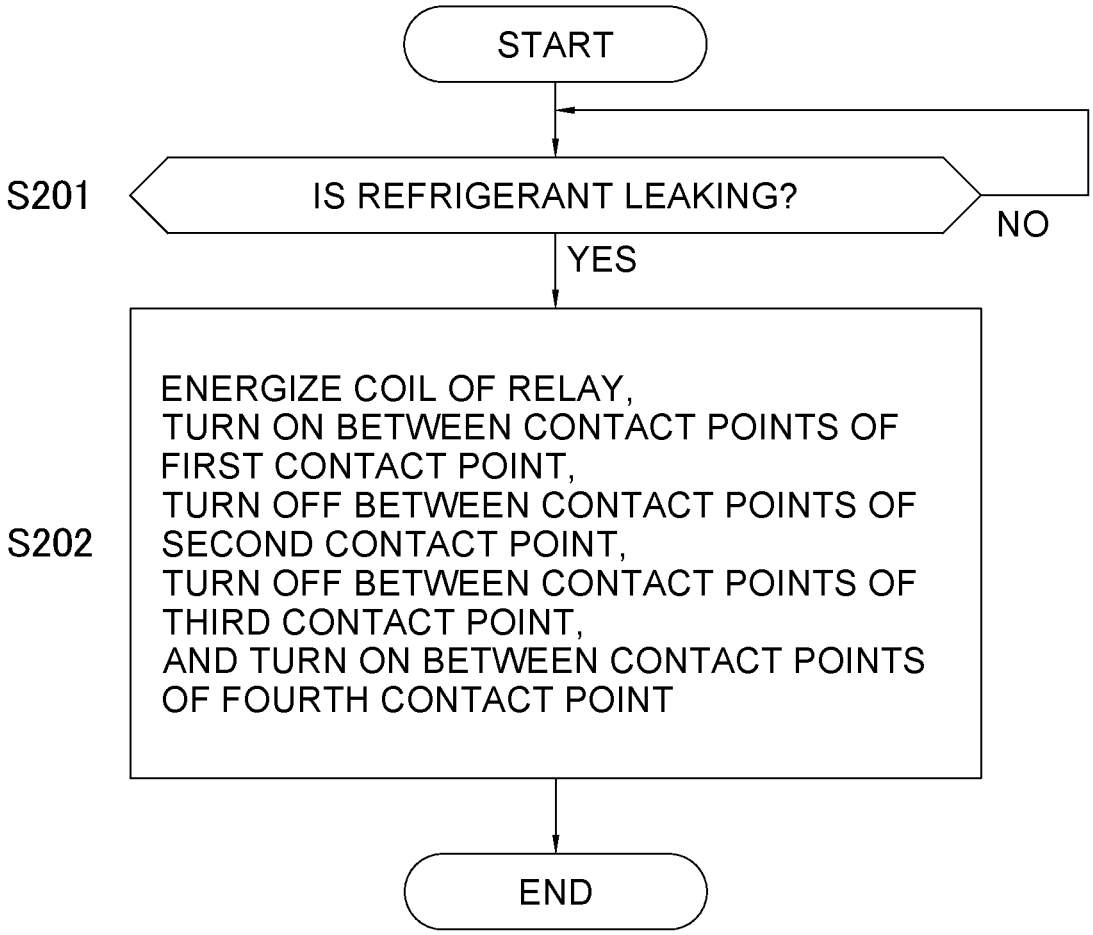
FIG. 7A is an operation flow chart of a communication line conduction and cut-off relay by a relay controller according to a first modified example of one or more embodiments of the present invention.

FIG. 7A is an operation flow chart of the communication line conduction and cut-off relay 50 by a relay controller 75 of a first modified example. Hereinafter, an operation of the air conditioning system 1 after refrigerant leakage detection will be described with reference to FIG. 7A.

(Step S201)

In FIG. 7A, the relay controller 75 determines the presence or absence of refrigerant leakage in step S201. When the relay controller 75 determines that "the refrigerant leaks", the process proceeds to step S202.

(Step S202)

Next, the relay controller 75 energizes a coil 50*a* of the communication line conduction and cut-off relay 50, and turns ON between contact points of the first contact point 501, turns OFF between contact points of the second contact point 502 and between contact points of the third contact point 503, and turns ON between contact points of the fourth contact point 504. The coil 50*a* is energized regardless of whether or not there is actual operation of the air conditioning system 1, that is, regardless of whether or not a compressor 321 is operated or a gas furnace unit 205 is operated.

Actions and effects when the contact points of the first contact point 501 are turned ON and the contact points of the second contact point 502 and the contact points of the third contact point 503 are turned OFF are similar to those in the above embodiments, and thus the description thereof will be omitted here.

The contact points of the fourth contact point 504 are connected such that terminals Rt and Ot of the thermostat 40 can be conducted, but are normally in an open state. For example, if a refrigerant leaks when a reverse valve operation command relay 45*f* is OFF, that is, when a four-way switching valve 328 is included in a heating operation cycle (a heating operation state: see a broken line of the four-way switching valve 328 in FIG. 2), an indoor heat exchanger 242 maintains a high pressure, which may cause leakage of a large amount of the refrigerant into the room.

Therefore, by turning ON between the contact points of the fourth contact point 504 to apply 24 V AC to a reverse valve operation command communication line SG6, an indoor-side microcomputer 32 determines as a control signal from the thermostat 40, and operates the four-way switching valve 328 to switch to a cooling cycle (a cooling operation state: see a solid line of the four-way switching valve 328 in FIG. 2). This eliminates the possibility of leakage of a large amount of the refrigerant into the room, enabling a safe state to be ensured.

(8-2) Second Modified Example

Figure 7B:
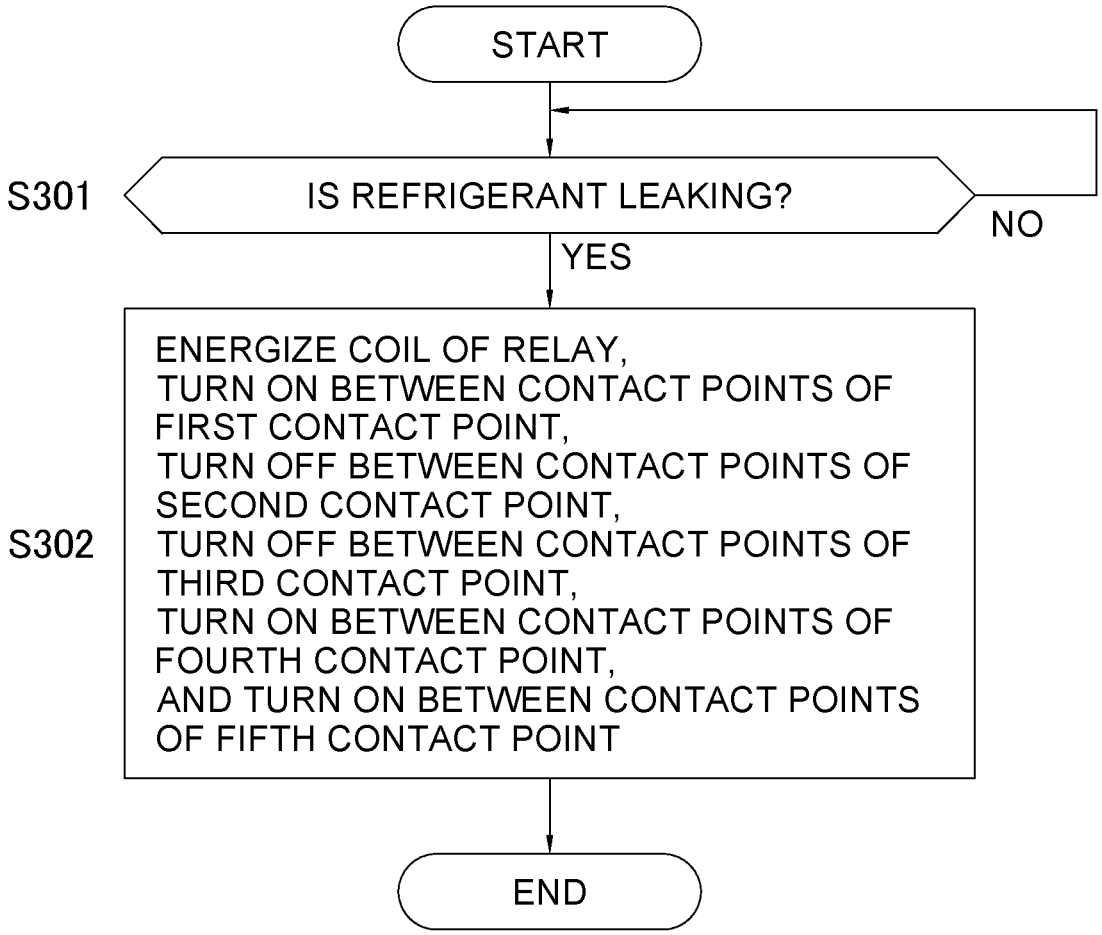
FIG. 7B is an operation flow chart of a communication line conduction and cut-off relay by a relay controller according to a second modified example of one or more embodiments of the present invention.

FIG. 7B is an operation flow chart of the communication line conduction and cut-off relay 50 by the relay controller 75 of a second modified example. Hereinafter, an operation of the air conditioning system 1 after refrigerant leakage detection will be described with reference to FIG. 7B.

(Step S301)

In FIG. 7B, the relay controller 75 determines the presence or absence of refrigerant leakage in step S301. When the relay controller 75 determines that "the refrigerant leaks", the process proceeds to step S302.

(Step S302)

Next, the relay controller 75 energizes the coil 50*a* of the communication line conduction and cut-off relay 50, turns ON between contact points of the first contact point 501, turns OFF between contact points of the second contact point 502 and contact points of the third contact point 503, and turns ON between contact points of the fourth contact point 504 and between contact points of the fifth contact point 505. The coil 50*a* is energized regardless of whether or not there is actual operation of the air conditioning system 1, that is, regardless of whether or not a compressor 321 is operated or a gas furnace unit 205 is operated.

Actions and effects when between the contact points of the first contact point 501 is turned ON, between the contact points of the second contact point 502 and between the contact points of the third contact point 503 are turned OFF, and between the contact points of the fourth contact point 504 is turned ON are similar to those of the first modified example, and thus the description thereof will be omitted here.

The contact points of the fifth contact point 505 are connected such that terminals Rt and Lt of the thermostat 40 can be conducted, but are normally in an open state. For example, if a refrigerant leaks when the alarm command relay 45*g* is OFF, no warning can be issued since the thermostat 40 itself cannot detect the refrigerant leakage.

Therefore, by turning ON between the contact points of the fifth contact point 505 to apply 24 V AC to the alarm command communication line SG7, the indoor-side microcomputer 32 can determine that a control signal (an alarm signal) from the thermostat 40 has been received, and alert a user by notifying with a warning sound or displaying on an existing display unit. This ensures a safe state.

Alternatively, regardless of its own operation, the thermostat 40 can also detect conduction between the terminal Rt and the terminal Lt of the thermostat 40, and use this as a trigger to display a warning message on the display unit. Of course, since the terminal Rt and the terminal Lt of the thermostat 40 are conducted, a warning signal can be inputted from an indoor-side control board 21 or an outdoor-side control board 31.

As described above, the air conditioning system 1 normally operates an air conditioner only with an ON or OFF signal from the thermostat 40, but can transmit a control signal to the thermostat 40 when a refrigerant leaks.

(9) Other Configurations (9-1)

In one or more embodiments and the modified examples described above, in the communication line conduction and cut-off relay 50, the fourth contact point 504 and the fifth contact point 505 are arranged so that the communication lines can be conducted or cut off, in addition to the first contact point 501, the second contact point 502, and the third contact point 503, but the present invention is not limited to the communication lines. For example, a contact point mechanism may be provided at each terminal of the terminal block 400 of the thermostat 40.

(9-2)

When refrigerant leakage is detected, regardless of a control signal of the thermostat the indoor fan 240 is operated by the communication line conduction and cut-off relay 50 closing between the contact points of the first contact point 501 to conduct the fan operation command communication line SG1. However, this is based on the premise of a mode in which the indoor fan 240 is stopped when the fan operation command communication line SG1 is in a cut-off state.

However, the present invention is not limited to this, and a mode may be adopted in which the indoor fan 240 is stopped when the fan operation command communication line SG1 is in a conductive state, and the indoor fan 240 is operated by the communication line conduction and cut-off relay 50 opening between the contact points of the first contact point 501, to cause the cut-off state of the fan operation command communication line SG1.

(9-3)

When refrigerant leakage is detected, regardless of a control signal of the thermostat the gas furnace unit 205 is stopped by the communication line conduction and cut-off relay opening between the contact points of the second contact point 502 to cut off the first heating operation command communication line SG2. However, this is based on the premise of a mode in which the gas furnace unit 205 is operated when the first heating operation command communication line SG2 is in a conductive state.

However, the present invention is not limited to this, and a mode may be adopted in which the gas furnace unit 205 is operated when the first heating operation command communication line SG2 is in a cut-off state, and the communication line conduction and cut-off relay 50 closes between the contact points of the second contact point 502 to cause a conductive state of the first heating operation command communication line SG2 and stop the gas furnace unit 205.

(9-4)

When refrigerant leakage is detected, regardless of a control signal of the thermostat 40, the compressor 321 is stopped by the communication line conduction and cut-off relay 50 opening between the contact points of the third contact point 503 to cut off the first compressor operation command communication line SG4. However, this is based on the premise of a mode in which the compressor 321 is operated when the first compressor operation command communication line SG4 is in a conductive state.

However, the present invention is not limited to this, and a mode may be adopted in which the compressor is operated when the first compressor operation command communication line SG4 is in a cut-off state, and the compressor 321 is stopped by the communication line conduction and cut-off relay 50 closing between the contact points of the third contact point 503, to cause a conductive state of the first compressor operation command communication line SG4.

(9-5)

When refrigerant leakage is detected, regardless of a control signal of the thermostat the four-way switching valve 328 is operated by the communication line conduction and cut-off relay 50 closing between the contact points of the fourth contact point 504 to conduct the reverse valve operation command communication line SG6. However, this is based on the premise of a mode in which the four-way switching valve 328 is in the heating operation state (see the broken line of the four-way switching valve 328 in FIG. 2) when the reverse valve operation command communication line SG6 is in a cut-off state.

However, the present invention is not limited to this, and a mode may be adopted in which the four-way switching valve 328 is in the heating operation state (see the broken line of the four-way switching valve 328 in FIG. 2) when the reverse valve operation command communication line SG6 is in a conductive state, and the four-way switching valve 328 is in the cooling operation state (see the solid line of the four-way switching valve 328 in FIG. 2) by the communication line conduction and cut-off relay 50 opening between the contact points of the fourth contact point 504 to cause a cut-off state of the reverse valve operation command communication line SG6.

(9-6)

When refrigerant leakage is detected, regardless of a control signal of the thermostat 40, a message is displayed on the display unit of the thermostat 40 by the communication line conduction and cut-off relay 50 closing between the contact points of the fifth contact point 505 to conduct the alarm command communication line SG7. However, this is based on the premise of a mode in which an alarm command is not issued when the alarm command communication line SG7 is in a cut-off state.

However, the present invention is not limited to this, and a mode may be adopted in which the alarm command is not issued when the alarm command communication line SG7 is in a conductive state, and the message is displayed on the display unit of the thermostat 40 by the communication line conduction and cut-off relay 50 opening between contact points of the fifth contact point 505 to cause a cut-off state of the alarm command communication line SG7.

The foregoing description concerns embodiments of the disclosure. It will be understood that numerous modifications and variations may be made without departing from the gist and scope of the disclosure.

(9-7)

In one or more embodiments and the modified examples described above, the description is made on an aspect in which the second heating operation command relay 45*c* is not used.

For example, when the separate heat source heating operation is performed using a first heater and a second heater, the first heater may be operated when the first heating operation command relay 45*b* is turned ON, and the second heater may be operated when the second heating operation command relay 45*c* is turned ON.

(9-8)

In one or more embodiments and the modified examples described above, the description is made on an aspect in which the second compressor operation command relay is not used.

For example, in an air conditioner equipped with a first compressor and a second compressor, the first compressor may be operated when the first compressor operation command relay 45*d* is turned ON, and the second compressor may be operated when the second compressor operation command relay 45*e* is turned ON.

(9-9)

In one or more embodiments and the modified examples described above, description is made with an example, as the air conditioner 10 of the air conditioning system 1, of an air conditioner that can switch between the cooling operation and the heating operation by the four-way switching valve 328, but the air conditioner is not limited to this.

For example, as the air conditioner 10, an air conditioner dedicated to cooling may be adopted in which the four-way switching valve 328 and the outdoor expansion valve 324 are removed from FIG. 2. In such a case, the heating operation is to be the separate heat source heating operation.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

2: indoor unit (utilization unit)
3: outdoor unit (heat source unit)
10: air conditioner
30: controller
21: indoor-side control board (controller)
31: outdoor-side control board (controller)
40: thermostat
50: communication line conduction and cut-off relay (relay)
60: leakage detection sensor
205: gas furnace unit (heater)
240: indoor fan
321: compressor
328: four-way switching valve
SG1: fan operation command communication line (second connection line)
SG2: first heating operation command communication line (fourth connection line)
SG4: first compressor operation command communication line (first connection line)
SG6: reverse valve operation command communication line (third connection line)
SG7: alarm command communication line (fifth connection line)

The invention claimed is:

1. An air conditioning system comprising:
a controller that controls an air conditioner;
a thermostat that
measures a temperature of an air conditioning target space,
changes a contact point to an ON state or an OFF state in accordance with a measurement result, and
manages input of a control signal to the controller to control operation of a component of the air conditioner;
a connection line group that electrically connects the thermostat and the controller, wherein the connection line group includes a compressor operation command communication line that controls a compressor of the air conditioner and a fan operation command communication line that controls an indoor fan of the air conditioner;
a relay that switches, to either a conductive state or a cut-off state, at least one of
the compressor operation command communication line and the fan operation command communication line;
a leakage detection sensor that detects refrigerant leakage from the air conditioner, and outputs a signal that controls the relay; and
a heater that is disposed separately from the air conditioner and that heats the air conditioning target space, wherein
the connection line group further includes a heating operation command communication line that controls the heater, and
when the leakage detection sensor detects refrigerant leakage from the air conditioner, the relay switches the heating operation command communication line to either a conductive state or a cut-off state.

2. The air conditioning system according to claim 1, wherein
the connection line group further includes a reverse valve operation command communication line that controls a four-way switching valve of the air conditioner, and
when the leakage detection sensor detects refrigerant leakage from the air conditioner, the relay switches the reverse valve operation command communication line to either a conductive state or a cut-off state.

3. The air conditioning system according to claim 1, wherein
the connection line group further includes an alarm command communication line that transmits a signal from the controller to the thermostat to notify that an abnormality has occurred, and
when the leakage detection sensor detects refrigerant leakage from the air conditioner, the relay switches the alarm command communication line to either a conductive state or a cut-off state.

4. The air conditioning system according to claim 1, wherein
each connection line of the connection line group includes at least one of a communication line or a terminal.

5. The air conditioning system according to claim 1, wherein
the air conditioner has an indoor unit and an outdoor unit.

6. A method of controlling an air conditioning system, the method comprising:
controlling an air conditioner with a controller;
measuring, with a thermostat, a temperature of an air conditioning target space;
changing, with the thermostat, a contact point to an ON state or an OFF state in accordance with a measurement result;
managing, with the thermostat, input of a control signal to the controller that controls operation of a component of the air conditioner;
connecting the thermostat and the controller with a connection line group including a compressor operation command communication line that controls a compressor of the air conditioner and a fan operation command communication line that controls an indoor fan of the air conditioner;
controlling, with a relay, a conductive state or a cut-off state of at least one of the compressor operation command communication line and the fan operation command communication line;
detecting, with a leakage detection sensor, refrigerant leakage from the air conditioner;

outputting, with the leakage detection sensor, a signal that controls the relay; and heating the air conditioning target space with a heater that is disposed separately from the air conditioner, wherein the connection line group further includes a heating operation command communication line that controls the heater, and when the leakage detection sensor detects refrigerant leakage from the air conditioner, the relay switches the heating operation command communication line to either a conductive state or a cut-off state.

7. The method according to claim 6, wherein the connection line group further includes a reverse valve operation command communication line that controls a four-way switching valve of the air conditioner, and when the leakage detection sensor detects refrigerant leakage from the air conditioner, the relay switches the reverse valve operation command communication line to either a conductive state or a cut-off state.

8. The method according to claim 6, wherein the connection line group further includes an alarm command communication line that transmits a signal from the controller to the thermostat to notify that an abnormality has occurred, and when the leakage detection sensor detects refrigerant leakage from the air conditioner, the relay switches the alarm command communication line to either a conductive state or a cut-off state.

9. The method according to claim 6, wherein connecting the thermostat and the controller with the connection line group includes connecting at least one of a communication line or a terminal for each connection line of the connection line group.

10. The method according to claim 6, wherein controlling the air conditioner includes controlling an indoor unit of the air conditioner and an outdoor unit of the air conditioner.

* * * * *